US010718061B2

(12) United States Patent
Arimori et al.

(10) Patent No.: US 10,718,061 B2
(45) Date of Patent: Jul. 21, 2020

(54) ELECTRODEPOSITION PAINT RECOVERY SYSTEM AND METHOD

(71) Applicant: ASAHI KASEI KABUSHIKI KAISHA, Tokyo (JP)

(72) Inventors: Yoshiro Arimori, Tokyo (JP); Toshiaki Kaneko, Tokyo (JP)

(73) Assignee: ASAHI KASEI KABUSHIKI KAISHA, Tokyo (JP)

( * ) Notice: Subject to any disclaimer, the term of this patent is extended or adjusted under 35 U.S.C. 154(b) by 384 days.

(21) Appl. No.: 15/538,068

(22) PCT Filed: Dec. 25, 2015

(86) PCT No.: PCT/JP2015/006485
§ 371 (c)(1),
(2) Date: Jun. 20, 2017

(87) PCT Pub. No.: WO2016/103732
PCT Pub. Date: Jun. 30, 2017

(65) Prior Publication Data

US 2017/0342588 A1 Nov. 30, 2017

(30) Foreign Application Priority Data

Dec. 26, 2014 (JP) ..... 2014-265507
Jun. 30, 2015 (JP) ..... 2015-130880

(51) Int. Cl.
*C25D 13/24* (2006.01)
*C25D 13/00* (2006.01)
(Continued)

(52) U.S. Cl.
CPC ..... *C25D 13/24* (2013.01); *C25D 13/00* (2013.01); *C25D 13/12* (2013.01); *C25D 13/20* (2013.01)

(58) Field of Classification Search
None
See application file for complete search history.

(56) References Cited

U.S. PATENT DOCUMENTS

2012/0024325 A1 2/2012 Arimori et al.
2015/0273397 A1 10/2015 Arimori et al.

FOREIGN PATENT DOCUMENTS

JP 54-100965 7/1979
JP 62-177196 8/1987
(Continued)

OTHER PUBLICATIONS

Search Report issued in International Application No. PCT/JP2015/006485 and English translation thereof, dated Mar. 22, 2016.
(Continued)

*Primary Examiner* — Kishor Mayekar
(74) *Attorney, Agent, or Firm* — Greenblum & Bernstein, P.L.C.

(57) ABSTRACT

An electrodeposition bath, water-washing baths, a first filtration membrane which feeds filtrate and concentrated-solution obtained by filtering electrodeposition-solution in the electrodeposition bath to the water-washing bath in a last stage and the electrodeposition bath, a feed system that feeds filtrate-water obtained by performing ultrafiltration or microfiltration on water after water-washing in the water-washing bath, a second filtration membrane which feeds filtrate and concentrated-solution obtained by filtering the filtrate-water fed by the feed system to the water-washing bath in the last stage and one of the electrodeposition bath and a water-washing bath other than the water-washing bath in the last stage, respectively, and a flow rate adjustment unit that adjusts a feed amount of each of the filtrate obtained by filtration by the first filtration membrane and the filtrate
(Continued)

obtained by filtration by the second filtration membrane to the water-washing bath in the last stage are included.

14 Claims, 8 Drawing Sheets

(51) Int. Cl.
*C25D 13/12* (2006.01)
*C25D 13/20* (2006.01)

(56) References Cited

FOREIGN PATENT DOCUMENTS

| | | |
|---|---|---|
| JP | 7-224397 | 8/1995 |
| JP | 2003-105594 | 4/2003 |
| JP | 2004-149899 | 5/2004 |
| JP | 2011-99158 | 5/2011 |
| KR | 10-2011-0084515 | 7/2011 |

OTHER PUBLICATIONS

Written Opinion issued in International Application No. PCT/JP2015/006485 and English Translation thereof, dated Mar. 22, 2016.

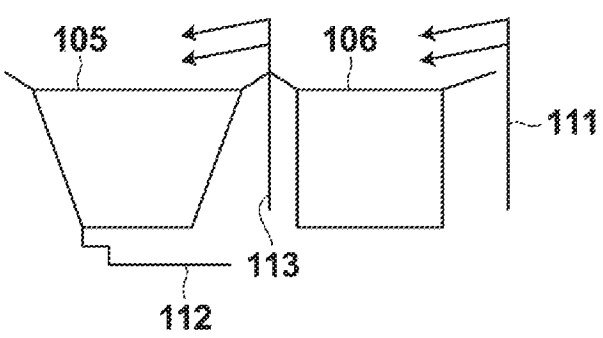
FIG.7
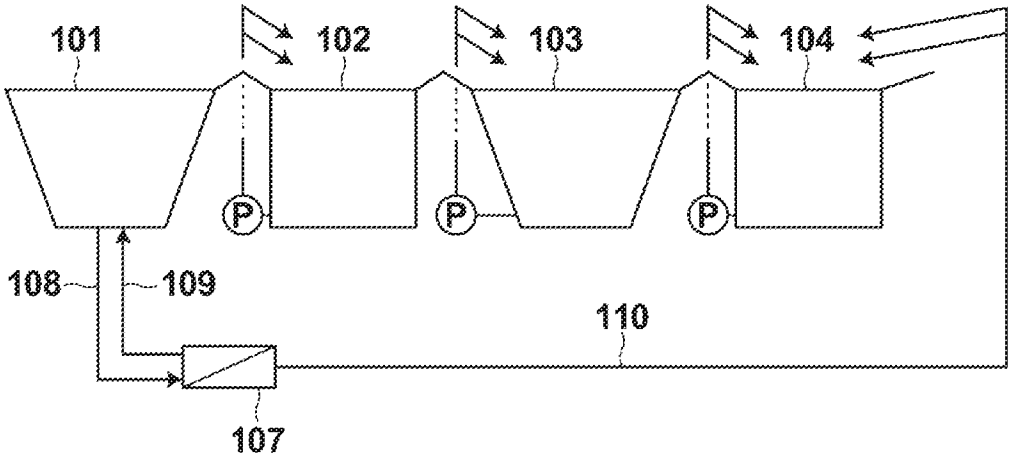
RELATED ART

ELECTRODEPOSITION PAINT RECOVERY SYSTEM AND METHOD

CROSS-REFERENCE TO RELATED APPLICATIONS

This application is a National Phase of PCT International Application No. PCT/JP2015/006485 filed on Dec. 25, 2015, which claims priority under 35 U.S.C § 119(a) to Japanese Patent Application No. 2014-265507 filed on Dec. 26, 2014 and Japanese Patent Application No. 2015-130880 filed on Jun. 30, 2015. Each of the above applications is hereby expressly incorporated by reference, in its entirety, into the present application.

TECHNICAL FIELD

The present disclosure relates to an electrodeposition paint recovery system and method that washes a painted object of an electrodeposition target with filtrate water obtained by filtration by using a filtration membrane, and also recovers and reuses non-electrodeposited paint washed off by washing.

BACKGROUND ART

Conventionally, electrodeposition painting has been widely used in painting automobile parts, electrical products, construction materials and the like as well as automobile bodies. An electrodeposition painting system is configured by an electrodeposition step of electrochemically forming a coating on an object to be painted, a washing step of washing off non-electrodeposited paint or the like, and further a baking step of hardening the coating. Generally, a water washing step is configured by a membrane filtration filtrate multistage recovery water washing step and a final water washing step.

The membrane filtration filtrate multistage recovery water washing step is a process in which paint physically adhered to the painted object is washed off by washing the painted object with filtrate obtained by filtering out paint in an electrodeposition bath by a filtration membrane, and also non-electrodeposited paint is recovered to the electrodeposition bath. Further, the final water washing step is a process in which washing for finishing is performed with pure water or purified water (industrial water), and a trace amount of paint or impurity ions that have not been able to be washed off in the membrane filtration filtrate multistage recovery water washing step is washed off. However, water used in washing is discharged outside from the process, as waste water.

FIG. 7 illustrates an example of a conventional electrodeposition paint recovery system. An electrodeposition bath 101 is illustrated in FIG. 7, and a membrane filtration filtrate multistage recovery water washing step is configured by three stages of a spray-type first water washing bath 102, a dip-type second water washing bath 103 and a spray-type third water washing bath 104. Further, the final water washing step is configured by two stages of a dip-type first water washing bath 105 and a spray-type second water washing bath 106. The spray-type water washing bath is a type of water washing bath in which a painted object is washed with water by spraying water for water washing onto the painted object. Meanwhile, the dip-type water washing bath has a larger amount of retained water for water washing than the spray-type water washing bath, and is a type of water washing bath in which a painted object is washed by completely immersing the painted object in water for water washing.

The object to be painted is mounted on a conveyer (not shown), and electrodeposition painting is performed on the object to be painted by immersing the object to be painted in the electrodeposition bath 101. After then, the painted object is washed with water by being conveyed sequentially to the first water washing bath 102, the second water washing bath 103 and the third water washing bath 104 in the membrane filtration filtrate multistage recovery water washing step, and to the first water washing bath 105 and the second water washing bath 106 in the final water washing step. A first membrane filtration apparatus 107 is illustrated. Electrodeposition solution is sent from the electrodeposition bath 101 to the first membrane filtration apparatus 107 through a line 108, and membrane filtration is performed. Concentrated solution that has not passed through the membrane is returned to the electrodeposition bath 101 through a line 109. Filtrate is sent to the last stage of the membrane filtration filtrate multistage recovery water washing step, which is the third water washing bath 104 in the example illustrated in FIG. 7, through a line 110, and used as water for water washing in the membrane filtration filtrate multistage recovery water washing step. The water for water washing in the membrane filtration filtrate multistage recovery water washing step sequentially overflows, one to another, from the third water washing bath 104 to the second water washing bath 103 and to the first water washing bath 102, and used as water for water washing in each of the water washing baths. After then, the water for water washing further overflows from the first water washing bath 102 to the electrodeposition bath 101, and non-electrodeposited paint is recovered. Pure water or purified water (industrial water) is fed, as water for water washing, to the first water washing bath 105 in the final water washing step through a line 113, and pure water or purified water (industrial water) is fed to the second water washing bath 106 through a line 111, and washing is performed. The pure water fed to the second water washing bath 106 overflows to the first water washing bath 105, and is discharged from a line 112 together with purified water fed to the first water washing bath 105.

However, the recovery water washing method by the conventional electrodeposition paint recovery system, as described above, had a problem of an increase in the amount of paint taken outside from electrodeposition painting facilities, because the concentration of non-electrodeposited paint in each of the water washing baths increased in a case where electrodeposition painting was performed on a large amount of object to be painted, or to prevent such a problem, the method had problems of an increase in the amount of purified water and pure water used in the final water washing step and an increased load of wastewater treatment. These problems are solvable by increasing the number of stages in the membrane filtration filtrate multistage recovery water washing step, but new problems of an increase in the cost of facilities and a space for setting arise.

To solve the aforementioned problems, Patent Literature 1 (Japanese Unexamined Patent Publication No. 7 (1995)-224397) proposed filtering water for water washing recovered in the first stage of the membrane filtration filtrate multistage recovery water washing step by an ultrafiltration membrane, and feeding the obtained filtrate to the last stage of the membrane filtration filtrate multistage recovery water washing step. However, in this method, for example, in a case where the water washing bath in the first stage is a spray-type water washing bath, the amount of filtrate obtained by performing ultrafiltration on the water for water washing recovered in the first stage is small. Therefore, there is a problem that the concentration of non-electrodeposited paint in the last stage is not sufficiently lowered.

Further, Patent Literature 2 (Japanese Unexamined Patent Publication No. 2011-99158) proposed taking out water for water washing recovered from a water washing bath provided between the first stage and the last stage of the membrane filtration filtrate multistage recovery water washing step, and after then, performing filtration by an ultrafiltration membrane, and feeding the obtained filtrate to the last stage of the membrane filtration filtrate multistage recovery water washing step.

FIG. 8 illustrates an electrodeposition paint recovery system disclosed in Patent Literature 2. In FIG. 8, the same numbers are assigned to apparatuses that are identical with those of FIG. 7. The electrodeposition paint recovery system illustrated in FIG. 8 is characterized in that a second membrane filtration apparatus 120 is newly provided for the dip-type second water washing bath 103 in the conventional electrodeposition paint recovery system illustrated in FIG. 7. The other features are the same as the conventional electrodeposition paint recovery system illustrated in FIG. 7. Second water washing bath solution is fed to the second membrane filtration apparatus 120 through a line 122, and concentrated solution that has not passed through the membrane is returned to the electrodeposition bath 101 through a line 121. The filtrate is fed to the third water washing bath 104 (the last stage of the membrane filtration filtrate multistage recovery water washing step) through a line 123, and used, as water for water washing, together with filtrate from the first membrane filtration apparatus 107 fed through the line 110.

Further, Patent Literature 3 (Japanese Unexamined Patent Publication No. 2004-149899) proposed filtering electrodeposition solution extracted from an electrodeposition bath by an ultrafiltration membrane, and filtering the obtained filtrate by a reverse osmosis membrane, and feeding the filtrate obtained by the reverse osmosis membrane to the last stage of the membrane filtration filtrate multistage recovery water washing step.

SUMMARY

Technical Problem

Here, the electrodeposition paint recovery system disclosed in Patent Literature 2 can feed a larger amount of water for water washing to the last stage of the membrane filtration filtrate multistage recovery water washing step, compared with the conventional electrodeposition paint recovery system illustrated in FIG. 7. Therefore, the concentration of non-electrodeposited paint in the last stage is further reducible. As a result, the amount of paint taken outside from electrodeposition painting facilities is reducible. In other words, the recovery rate of electrodeposition paint is increasable, and further, the amount of purified water and pure water used in the final water washing step is reducible.

However, experiments by the inventors showed that the recovery rate of electrodeposition paint remained at 97% even in the electrodeposition paint recovery system illustrated in FIG. 8, and further improvement was needed.

Further, in the electrodeposition paint recovery system disclosed in Patent Literature 3, concentrated solution obtained by the reverse osmosis membrane is returned to a water washing bath between the water washing bath in the first stage and the water washing bath in the last stage, but the concentrated solution contains a large amount of impurity ions that have not passed through the membrane. The impurity ions returned to the water washing bath flow toward the electrodeposition bath, and returned to the electrodeposition bath. Since these impurity ions were introduced in a pretreatment step before performing electrodeposition on the object to be painted, the concentration of impurity ions in the electrodeposition solution in the electrodeposition bath becomes higher as many painted objects are washed. As a result, a problem of deterioration in the quality of electrodeposition painting arises.

Impurity ions are alkali ions, metal ions, nitric acid radicals and the like. In an electrodeposition bath, a fluctuation of alkali ions of these impurity ions is particularly large. Generally, it is known that the quality of painting deteriorates as alkali ions exceed 30 ppm. The alkali ions include Na ions and K ions. Since the concentration of K ions is about 1 ppm, which is low, it is especially important to manage the concentration of Na ions.

In view of the foregoing circumstances, the present disclosure is directed to provide an electrodeposition paint recovery system and method that can further improve a paint recovery rate by efficiently increasing water for water washing in the last stage of the membrane filtration filtrate multistage recovery water washing step, and that can also improve the quality of electrodeposition painting by suppressing an increase in the concentration of Na ions contained in electrodeposition solution in an electrodeposition bath.

An electrodeposition paint recovery system of the present disclosure includes an electrodeposition bath in which electrodeposition painting is performed on an object to be painted, at least two water washing baths in which the object to be painted after electrodeposition painting is washed stepwise with water, a first filtration membrane which is an ultrafiltration membrane or a microfiltration membrane, and which feeds filtrate and concentrated solution obtained by filtering electrodeposition solution containing electrodeposition paint in the electrodeposition bath to the water washing bath in the last stage and the electrodeposition bath, respectively, a feed system that feeds filtrate water obtained by performing ultrafiltration or microfiltration on one of the electrodeposition solution in the electrodeposition bath and water after water washing in the water washing bath, a second filtration membrane which is a reverse osmosis membrane, and which feeds filtrate and concentrated solution obtained by filtering the filtrate water fed by the feed system to the water washing bath in the last stage and one of the electrodeposition bath and a water washing bath other than the water washing bath in the last stage, respectively, and a flow rate adjustment unit that adjusts a feed amount of each of the filtrate obtained by filtration by the first filtration membrane and the filtrate obtained by filtration by the second filtration membrane to the water washing bath in the last stage, and water after water washing is fed from the water washing bath in the last stage sequentially to the water washing bath or baths located toward the electrodeposition bath and the electrodeposition bath.

In the electrodeposition paint recovery system of the present disclosure, the feed system may include a third filtration membrane which is an ultrafiltration membrane or a microfiltration membrane, and which feeds filtrate and concentrated solution obtained by filtering water after water washing in one of the at least two water washing baths to the second filtration membrane and a water washing bath located more toward the electrodeposition bath side than the water washing bath in the last stage, respectively, through the feed system.

In the electrodeposition paint recovery system of the present disclosure, the first filtration membrane may feed the filtrate obtained by filtering the electrodeposition solution also to the second filtration membrane through the feed system.

In the electrodeposition paint recovery system of the present disclosure, the flow rate adjustment unit may adjust the feed amount so that ratio V1:V2 of feed amount V1 of the filtrate obtained by filtration by the first filtration membrane to the water washing bath in the last stage and feed amount V2 of the filtrate obtained by filtration by the second filtration membrane to the water washing bath in the last stage becomes 1:2 through 2:1.

In the electrodeposition paint recovery system of the present disclosure, it is preferable that the flow rate adjustment unit adjusts the feed amount so that the ratio V1:V2 becomes 1:1.

In the electrodeposition paint recovery system of the present disclosure, the flow rate adjustment unit may adjust the feed amount of the filtrate obtained by filtration by the first filtration membrane to the water washing bath in the last stage and the feed amount of the filtrate obtained by filtration by the second filtration membrane to the water washing bath in the last stage so that the Na ion concentration of water after water washing in a water washing bath closest to the electrodeposition bath is 30 ppm or less.

The electrodeposition paint recovery system of the present disclosure may include a measurement unit that measures the electrical conductivity of water after water washing in the water washing bath in the last stage, and the flow rate adjustment unit may automatically adjust, based on the electrical conductivity measured by the measurement unit, the feed amount of the filtrate obtained by filtration by the first filtration membrane to the water washing bath in the last stage and the feed amount of the filtrate obtained by filtration by the second filtration membrane to the water washing bath in the last stage.

Further, it is preferable that the reverse osmosis membrane has a positive zeta potential.

An electrodeposition paint recovery method of the present disclosure is an electrodeposition paint recovery method in which an electrodeposition bath in which electrodeposition painting is performed on an object to be painted, at least two water washing baths in which the object to be painted after electrodeposition painting is washed stepwise with water, and a first filtration membrane which is an ultrafiltration membrane or a microfiltration membrane, and which feeds filtrate and concentrated solution obtained by performing filtration on electrodeposition solution containing electrodeposition paint in the electrodeposition bath to the water washing bath in the last stage and the electrodeposition bath, respectively, are used, and water after water washing is fed from the water washing bath in the last stage sequentially to the water washing bath or baths located toward the electrodeposition bath and the electrodeposition bath. The method includes filtering, by a second filtration membrane which is a reverse osmosis membrane, filtrate water obtained by performing ultrafiltration or microfiltration on one of the electrodeposition solution in the electrodeposition bath and water after water washing in the water washing bath, feeding filtrate and concentrated solution obtained by the filtering to the water washing bath in the last stage and one of the electrodeposition bath and a water washing bath other than the water washing bath in the last stage, respectively, and adjusting a feed amount of each of the filtrate obtained by filtration by the first filtration membrane and the filtrate obtained by filtration by the second filtration membrane to the water washing bath in the last stage.

In the electrodeposition paint recovery method of the present disclosure, water after water washing in one of the at least two water washing baths may be filtered by using a third filtration membrane which is an ultrafiltration membrane or a microfiltration membrane, and filtrate and concentrated solution obtained by the filtering may be fed to the second filtration membrane and a water washing bath located more toward the electrodeposition bath side than the water washing bath in the last stage, respectively.

In the electrodeposition paint recovery method of the present disclosure, the first filtration membrane may feed the filtrate obtained by filtering the electrodeposition solution also to the second filtration membrane.

In the electrodeposition paint recovery method of the present disclosure, ratio V1:V2 of feed amount V1 of the filtrate obtained by filtration by the first filtration membrane to the water washing bath in the last stage and feed amount V2 of the filtrate obtained by filtration by the second filtration membrane to the water washing bath in the last stage may be adjusted so as to be 1:2 through 2:1.

In the electrodeposition paint recovery method of the present disclosure, it is preferable that the ratio V1:V2 is adjusted so as to be 1:1.

In the electrodeposition paint recovery method of the present disclosure, the feed amount of the filtrate obtained by filtration by the first filtration membrane to the water washing bath in the last stage and the feed amount of the filtrate obtained by filtration by the second filtration membrane to the water washing bath in the last stage may be adjusted so that the Na ion concentration of water after water washing in a water washing bath closest to the electrodeposition bath is 30 ppm or less.

In the electrodeposition paint recovery method of the present disclosure, the electrical conductivity of water after water washing in the water washing bath in the last stage may be measured, and the feed amount of the filtrate obtained by filtration by the first filtration membrane to the water washing bath in the last stage and the feed amount of the filtrate obtained by filtration by the second filtration membrane to the water washing bath in the last stage may be automatically adjusted based on the measured electrical conductivity.

In the electrodeposition paint recovery method of the present disclosure, it is preferable that the second filtration membrane has a positive zeta potential.

According to the electrodeposition paint recovery system and method of the present disclosure, the second filtration membrane which is a reverse osmosis membrane, and to which filtrate obtained by performing ultrafiltration or microfiltration on the electrodeposition solution in the electrodeposition bath or water after water washing in the water washing bath, is included in addition to the first filtration membrane that filters electrodeposition solution containing electrodeposition paint in the electrodeposition bath.

Further, the filtrate obtained by filtration by the second filtration membrane in addition to the filtrate obtained by filtration by the first filtration membrane is fed to the water washing bath in the last stage. It is possible to increase the water for water washing in the last stage by further filtering, by the reverse osmosis membrane, the filtrate obtained by ultrafiltration or microfiltration in this manner, and also to reduce the non-electrodeposit paint. Therefore, it is possible to greatly increase the paint recovery rate, compared with the conventional electrodeposition paint recovery system. As a result, pure water for washing in the final water washing step and its drainage water are reducible.

Further, the feed amount of the filtrate obtained by filtration by the second filtration membrane to the water washing bath in the last stage and the feed amount of the filtrate obtained by filtration by the first filtration membrane to the water washing bath in the last stage are adjusted. Therefore, it is possible to suppress an increase in the Na ion concentration of the electrodeposition solution in the electrodeposition bath. Therefore, it is possible to improve the quality of electrodeposition painting.

Specifically, concentrated solution having high Na ion concentration is returned to the electrodeposition bath or the water washing bath by performing filtration by the second filtration membrane which is the reverse osmosis membrane, and the Na ion concentration is accumulated in the electrodeposition bath. However, since it is possible to allow Na ions to escape to the filtrate side while the electrodeposition solution containing the accumulated Na ions is filtered by the first filtration membrane, it is possible to suppress an increase in the Na ion concentration of the electrodeposition solution in the electrodeposition bath. Further, it is possible to suppress an increase in the Na ion concentration in the whole system by adjusting the feed amount of the filtrate obtained by filtration by the second filtration membrane, and the Na ion concentration of which has been reduced, to the water washing bath in the last stage and the feed amount of the filtrate obtained by filtration by the first filtration membrane, and which contains Na ions of the electrodeposition solution in the electrodeposition bath, to the water washing bath in the last stage.

BRIEF DESCRIPTION OF THE DRAWINGS

FIG. 7 A diagram illustrating an example of a conventional electrodeposition paint recovery system.

DESCRIPTION OF EMBODIMENTS

Figure 1:
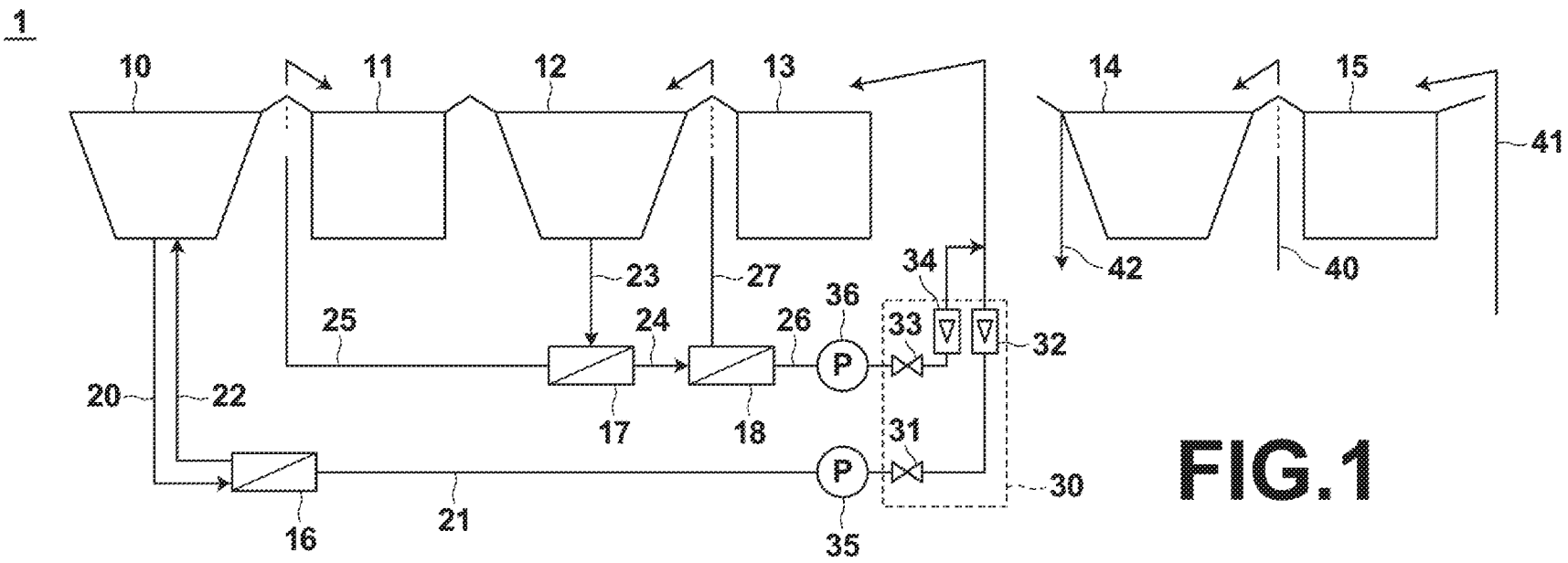
FIG. 1 A schematic diagram illustrating the configuration of an electrodeposition paint recovery system according to a first embodiment of the present disclosure.

Hereinafter, a first embodiment of an electrodeposition paint recovery system and method of the present disclosure will be described with reference to drawings. FIG. 1 is a schematic diagram illustrating the configuration of an electrodeposition paint recovery system 1 according to the present embodiment.

As illustrated in FIG. 1, the electrodeposition paint recovery system 1 according to the present embodiment includes an electrodeposition bath 10, a first water washing bath 11, a second water washing bath 12, a third water washing bath 13, a fourth water washing bath 14, a fifth water washing bath 15, a first filtration membrane apparatus 16, a second filtration membrane apparatus 18, and a third filtration membrane apparatus 17.

The electrodeposition bath 10 is a bath in which electrodeposition painting is performed on an object to be painted, such as automobile bodies, electrical products and construction materials. In the electrodeposition bath 10, cation electrodeposition solution containing electrodeposition paint made of epoxy-based resin, pigment and the like, solvent, organic acid, pure water and the like is stored.

The first water washing bath 11, the second water washing bath 12, and the third water washing bath 13 are used to perform the membrane filtration filtrate multistage recovery water washing step. The first water washing bath 11 and the third water washing bath 13 are spray-type water washing baths, and the second water washing bath 12 is a dip-type water washing bath. The spray-type water washing bath is a type of water washing bath in which a painted object is washed with water by spraying water for water washing onto the painted object. Meanwhile, the dip-type water washing bath is a type of water washing bath having a larger amount of retained water for water washing than the spray-type water washing bath, and which washes, with water, the painted object by completely immersing the painted object in the water for water washing.

The fourth water washing bath 14 and the fifth water washing bath 15 are used to perform the final water washing step. The fourth water washing bath 14 is a dip-type water washing bath, and the fifth water washing bath 15 is a spray-type water washing bath.

The first filtration membrane apparatus 16 includes an ultrafiltration membrane or a microfiltration membrane (corresponding to the first filtration membrane). The ultrafiltration membrane is a filtration membrane having an average pore diameter of about 0.001 μm through 0.01 μm, and the microfiltration membrane is a filtration membrane having an average pore diameter of about 0.01 nm through 10 μm. Here, the average pore diameters of the ultrafiltration membrane and the microfiltration membrane are calculated as follows.

First, the ultrafiltration membrane or microfiltration membrane is cut along a cross section perpendicular to its longitudinal direction. The cross section is imaged, by using a scan-type electron microscope, about at a magnification at which the shapes of as many pores as possible are clearly recognizable. Next, a transparent sheet is laid on a copy of the electron microscopic image, and pore portions are completely colored black by using a black pen or the like. The pore portions in black and non-pore portions in white are clearly distinguished by copying the transparent sheet to white paper. After then, the pore diameters of arbitrarily selected 100 pores are obtained by using commercially available image analysis software, and an average pore diameter is calculated by obtaining an arithmetic mean of the obtained values. As the image analysis software, for example, software "WinRoof" sold by MITANI CORPORATION may be used. Here, the pore diameter means a distance between an arbitrary point on the circumference of a pore and a point on the circumference of the pore opposite to the arbitrary point.

The first filtration membrane apparatus 16 filters the electrodeposition solution in the electrodeposition bath 10, and the electrodeposition solution is fed from the electrodeposition bath 10 to the first filtration membrane apparatus 16 through a flow path 20. Filtrate water obtained by filtration by the first filtration membrane apparatus 16 is sent to the third water washing bath 13, which is the last stage of the membrane filtration filtrate multistage recovery water washing step, through a flow path 21, and used as water for water washing in the membrane filtration filtrate multistage recovery water washing step. Meanwhile, concentrated solution that has not passed through the membrane in the first filtration membrane apparatus 16 is returned to the electrodeposition bath 10 through a flow path 22.

Figure 2:
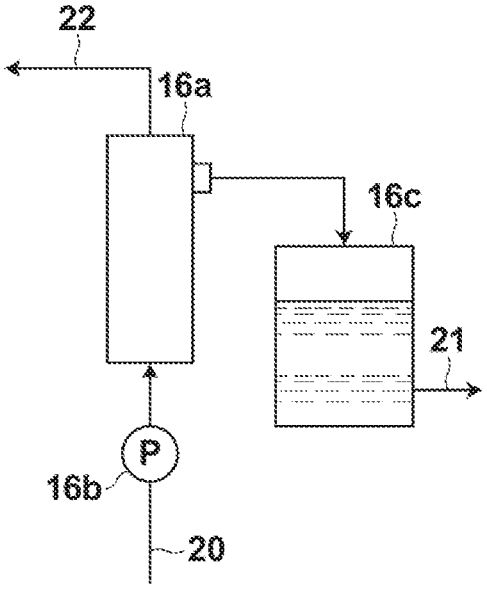
FIG. 2 A schematic diagram illustrating the configuration of first through third filtration membrane apparatuses.

FIG. 2 is a schematic diagram illustrating the specific configuration of the first filtration membrane apparatus 16. As illustrated in FIG. 2, the first filtration membrane apparatus 16 includes a hollow fiber membrane module 16*a* having an ultrafiltration membrane or microfiltration membrane, a pump 16*b* for feeding raw water (electrodeposition solution) to the hollow fiber membrane module 16*a*, and a tank 16*c* in which filtrate water obtained by filtration by the hollow fiber membrane module 16*a* is temporarily retained. The filtrate water retained in the tank 16*c* is sucked by a pump 35 provided in a flow path 21, and fed to the flow path 21.

The third filtration membrane apparatus 17 also includes an ultrafiltration membrane or microfiltration membrane (corresponding to the third filtration membrane). The third filtration membrane apparatus 17 filters water for water washing in the second water washing bath 12, and the water for water washing is fed from the second water washing bath 12 to the third filtration membrane apparatus 17 through a flow path 23. Further, filtrate water obtained by filtration by the third filtration membrane apparatus 17 is fed to the second filtration membrane apparatus 18 connected in the later stage through a flow path 24. In the present embodiment, the third filtration membrane apparatus 17 and the flow path 24 correspond to the feed system.

Meanwhile, concentrated solution that has not passed through the membrane in the third filtration membrane apparatus 17 is returned, through a flow path 25, to the first water washing bath 11 provided more toward the electrodeposition bath 10 side than the second water washing bath 12. In the present embodiment, the concentrated solution of the third filtration membrane apparatus 17 is returned to the first water washing bath 11. Alternatively, the concentrated solution may be returned to the electrodeposition bath 10. Further, in the present embodiment, water for water washing in the second water washing bath 12 is fed to the third filtration membrane apparatus 17, as water to be filtrated. Alternatively, water for water washing that is not from the second water washing bath 12 may be fed as water to be filtrated. Specifically, water for water washing in the first water washing bath 11 or water for water washing in the third water washing bath 13 may be fed to the third filtration membrane apparatus 17.

The third filtration membrane apparatus 17 is also configured similarly to the first filtration membrane apparatus 16, illustrated in FIG. 2. The third filtration membrane apparatus 17 also includes a hollow fiber membrane module including an ultrafiltration membrane or a microfiltration membrane, a pump for feeding raw water to the hollow fiber membrane module, and a tank in which filtrate water obtained by filtration by the hollow fiber membrane module is temporarily retained. Further, the filtrate water retained in the tank is sucked by the pump provided in the third filtration membrane apparatus 17, and fed to a flow path 24.

The second filtration membrane apparatus 18 includes a reverse osmosis membrane (corresponding to the second filtration membrane). The reverse osmosis membrane (RO (Reverse Osmosis) membrane) is a membrane having a smaller average pore diameter than an NF (Nano filtration) membrane and a salt rejection rate of 90% or higher.

The filtrate water of the third filtration membrane apparatus 17 is fed to the second filtration membrane apparatus 18 through the flow path 24, as described above. The second filtration membrane apparatus 18 further removes impurity ions including Na ions from the filtrate water of the third filtration membrane apparatus 17. Further, the filtrate water obtained by filtration by the second filtration membrane apparatus 18 is sent, through a flow path 26, to the third water washing bath 13, which is the last stage of the membrane filtration filtrate multistage recovery water washing step, and used as water for water washing in the membrane filtration filtrate multistage recovery water washing step. Meanwhile, concentrated solution that has not passed through the membrane in the second filtration membrane apparatus 18 is returned to the second water washing bath 12 through a flow path 27. In the present embodiment, the concentrated solution of the second filtration membrane apparatus 18 is returned to the water washing bath 12. Alternatively, the concentrated solution may be returned to the electrodeposition bath 10 or the first water washing bath 11.

Here, the second filtration membrane apparatus 18 is configured similarly to the first filtration membrane apparatus 16, illustrated in FIG. 2, except that the kind of the membrane of the hollow fiber module is a reverse osmosis membrane. The second filtration membrane apparatus 18 includes a hollow fiber membrane module including a reverse osmosis membrane, a pump for feeding raw water to the hollow fiber membrane module, and a tank that temporarily retains filtrate water obtained by filtration by the hollow fiber membrane module. Further, the filtrate water retained in the tank is sucked by a pump 36 provided in the flow path 26, and fed to the flow path 26.

Further, in the electrodeposition paint recovery system 1 configured as described above, an object to be painted is mounted on a conveyer (not illustrated), and electrodeposition painting is performed on the object to be painted by immersing the object to be painted in the electrodeposition bath 10. After then, the painted object is washed with water by being conveyed sequentially to the first water washing bath 11, the second water washing bath 12 and the third water washing bath 13 in the membrane filtration filtrate multistage recovery water washing step. Next, the painted object is washed with water by being conveyed sequentially to the fourth water washing bath 14 and the fifth water washing bath 15 in the final water washing step.

The water for water washing in the membrane filtration filtrate multistage recovery water washing step sequentially overflows, one to another, from the third water washing bath 13 to the second water washing bath 12 and to the first water washing bath 11, and used as water for water washing in each of the water washing baths. After then, the water for water washing further overflows from the first water washing bath 11 to the electrodeposition bath 10, and non-electrodeposited paint is recovered.

Pure water or purified water (industrial water) as water for water washing is fed, through a flow path 40, to the fourth water washing bath 14 in the final water washing step, and pure water or purified water (industrial water) is fed, through a flow path 41, to the fifth water washing bath 15, and washing is performed. The pure water fed to the fifth water washing bath 15 overflows to the fourth water washing bath 14, and is discharged from a flow path 42 together with the pure water fed to the fourth water washing bath 14.

Further, the electrodeposition paint recovery system 1 includes a flow rate adjustment unit 30 that adjusts the feed amount of filtrate water filtrated by the second filtration membrane apparatus 18 to the third water washing bath 13 and the feed amount of filtrate water filtrated by the first filtration membrane apparatus 16 to the third water washing bath 13 in the membrane filtration filtrate multistage recovery water washing step as described above.

The flow rate adjustment unit 30 includes a first valve mechanism 31 and a first flow meter 32 provided in the flow path 21 connected to the first filtration membrane apparatus 16, and a second valve mechanism 33 and a second flow meter 34 provided in the flow path 26 connected to the second filtration membrane apparatus 18. The feed amount of filtrate water obtained by filtration by the first filtration membrane apparatus 16 to the third water washing bath 13 is adjusted by the first valve mechanism 31 and the first flow meter 32. The feed amount of filtrate water obtained by filtration by the second filtration membrane apparatus 18 to the third water washing bath 13 is adjusted by the second valve mechanism 33 and the second flow meter 34. The feed amount of the filtrate water may be adjusted automatically or manually.

According to the electrodeposition paint recovery system 1 of the first embodiment, the third filtration membrane apparatus 17 that filters water after water washing in the second water washing bath 12 is included in addition to the first filtration membrane apparatus 16 that filters electrodeposition solution containing electrodeposition paint in the electrodeposition bath 10. The filtrate obtained by filtration by the third filtration membrane apparatus 17 is fed to the second filtration membrane apparatus 18 which is a reverse osmosis membrane.

Further, filtrate obtained by filtration by the second filtration membrane apparatus 18, in addition to the filtrate obtained by filtration by the first filtration membrane apparatus 16, is fed to the third water washing bath 13 in the last stage. It is possible to increase the water for water washing in the last stage, and also to reduce non-electrodeposited paint by further filtering, by the second filtration membrane apparatus 18 which is a reverse osmosis membrane, the filtrate obtained by filtration by the third filtration membrane apparatus 17, and feeding the filtrate to the third water washing bath 13 in the last stage, as described above. As a result, it is possible to further improve the paint recovery rate.

Further, since the feed amount of filtrate obtained by filtration by the second filtration membrane apparatus 18 to the third water washing bath 13 in the last stage and the feed amount of filtrate obtained by filtration by the first filtration membrane apparatus 16 to the third water washing bath 13 in the last stage are adjusted, it is possible to suppress an increase in the Na ion concentration of electrodeposition solution in the electrodeposition bath, and to prevent deterioration in the quality of electrodeposition painting.

Specifically, concentrated solution having a high Na ion concentration is returned to the second water washing bath 12 by performing filtration by the second filtration membrane apparatus 18 which is a reverse osmosis membrane. As a result, the Na ion concentration is accumulated in the electrodeposition bath 10. However, since it is possible to allow Na ions to escape to the filtrate side while the electrodeposition solution containing the accumulated Na ions is filtered by the first filtration membrane apparatus 16, it is possible to suppress an increase in the Na ion concentration of the electrodeposition solution in the electrodeposition bath 10. Further, it is possible to suppress an increase in the Na ion concentration in the whole system by adjusting the feed amount of filtrate of the second filtration membrane apparatus 18 the Na ion concentration of which has been reduced to the third water washing bath 13 and the feed amount of filtrate of the first filtration membrane apparatus 16 containing the Na ions of the electrodeposition solution in the electrodeposition bath 10 to the third water washing bath 13.

Further, it is desirable that the flow rate adjustment unit 30 adjusts feed amount V1 of filtrate water obtained by filtration by the first filtration membrane apparatus 16 to the third water washing bath 13 and feed amount V2 of filtrate water obtained by filtration by the second filtration membrane apparatus 18 to the third water washing bath 13 so that V1:V2=1:2 through 2:1 is satisfied. It is more preferable that V1:V2=1:1 is satisfied. It is possible to lower the accumulation of Na ions, which causes deterioration in the quality of painting, to 30 ppm or less, and to increase the paint recovery rate to 97.2% or higher by controlling the ratio of feed amount V1 of the filtrate water of the first filtration membrane apparatus 16 and feed amount V2 of the filtrate water of the second filtration membrane apparatus 18 in this manner.

Figure 3:
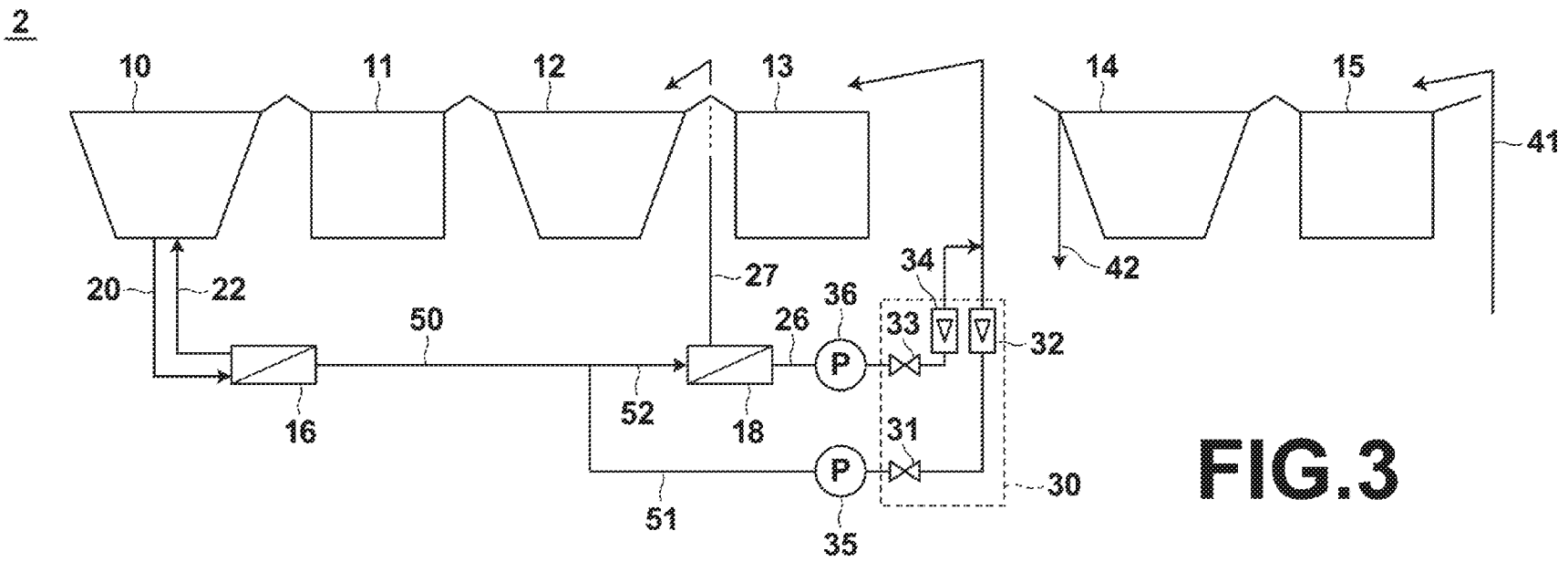
FIG. 3 A schematic diagram illustrating the configuration of an electrodeposition paint recovery system according to a second embodiment of the present disclosure.

Next, a second embodiment of the electrodeposition paint recovery system and method of the present disclosure will be described. FIG. 3 is a schematic diagram illustrating the configuration of an electrodeposition paint recovery system 2.

In the electrodeposition paint recovery system 2 of the second embodiment, the third filtration membrane apparatus 17 in the electrodeposition paint recovery system 1 of the first embodiment is not provided, and the first filtration membrane apparatus 16 is used also as the third filtration membrane apparatus 17. Since the other configuration is similar to the electrodeposition paint recovery system 1 of the first embodiment, detailed explanation will be omitted.

The first filtration membrane apparatus 16 is configured similarly to the first embodiment, and includes an ultrafiltration membrane or a microfiltration membrane. The first filtration membrane apparatus 16 filters electrodeposition solution in the electrodeposition bath 10, and the electrodeposition solution is fed from the electrodeposition bath 10 to the first filtration membrane apparatus 16 through the flow path 20. Further, the filtrate water obtained by filtration by the first filtration membrane apparatus 16 of the present embodiment is sent to the third water washing bath 13, which is the last stage of the membrane filtration filtrate multistage recovery water washing step, through a flow path 50 and a flow path 51, and also fed to the second filtration membrane apparatus 18 through a flow path 52. In the present embodiment, the first filtration membrane apparatus 16 and the flow path 52 correspond to the feed system.

Concentrated solution that has not passed the membrane in the first filtration membrane apparatus 16 is returned to the electrodeposition bath 10 through the flow path 22. A pump 35 for sucking filtrate water retained in a tank of the first filtration membrane apparatus 16 is provided in the flow path 51.

The second filtration membrane apparatus 18 is configured similarly to the first embodiment, and includes a reverse osmosis membrane. Filtrate water of the first filtration membrane apparatus 16 is fed to the second filtration membrane apparatus 18 through the flow path 52, as described above. The second filtration membrane apparatus 18 further removes impurity ions including Na ions from the filtrate water of the first filtration membrane apparatus 16. Further, the filtrate water obtained by filtration by the second filtration membrane apparatus 18 is sent to the third water washing bath 13, which is the last stage of the membrane filtration filtrate multistage recovery water washing step, through the flow path 26, and used as water for water washing in the membrane filtration filtrate multistage recovery water washing step. Meanwhile, concentrated solution that has not passed through the membrane in the second filtration membrane apparatus 18 is returned to the second water washing bath 12 through the flow path 27. In the present embodiment, the concentrated solution of the second filtration membrane apparatus 18 is returned to the second water washing bath 12. Alternatively, the concentrated solution may be returned to the electrodeposition bath 10 or the first water washing bath 11.

Further, filtrate water retained in the tank of the second filtration membrane apparatus 18 is sucked by a pump 36 provided in the flow path 26 and fed to the flow path 26 in a similar manner to the first embodiment.

Further, the electrodeposition paint recovery system 2 of the second embodiment includes a flow rate adjustment unit 30 that adjusts the feed amount of filtrate water filtrated by the second filtration membrane apparatus 18 to the third water washing bath 13 and the feed amount of filtrate water filtrated by the first filtration membrane apparatus 16 to the third water washing bath 13 in the membrane filtration filtrate multistage recovery water washing step in a similar manner to the electrodeposition paint recovery system 1 of the first embodiment. The flow rate adjustment unit 30 is configured similarly to the first embodiment.

According to the electrodeposition paint recovery system 2 of the second embodiment, the second filtration membrane apparatus 18 which is a reverse osmosis membrane that filters filtrate of the first filtration membrane apparatus 16 is included in addition to the first filtration membrane apparatus 16 that filters electrodeposition solution containing electrodeposition paint in the electrodeposition bath 10.

Further, filtrate obtained by filtration by the second filtration membrane apparatus 18, in addition to the filtrate obtained by filtration by the first filtration membrane apparatus 16, is fed to the third water washing bath 13 in the last stage. It is possible to increase the water for water washing in the last stage, and also to reduce non-electrodeposited paint by further filtering, by the second filtration membrane apparatus 18 which is a reverse osmosis membrane, the filtrate obtained by filtration by the first filtration membrane apparatus 16, and feeding the filtrate to the third water washing bath 13 in the last stage, as described above. As a result, it is possible to further improve the paint recovery rate.

Further, since the feed amount of filtrate obtained by filtration by the second filtration membrane apparatus 18 to the third water washing bath 13 in the last stage and the feed amount of filtrate obtained by filtration by the first filtration membrane apparatus 16 to the third water washing bath 13 in the last stage are adjusted, it is possible to suppress an increase in the Na ion concentration of the electrodeposition solution in the electrodeposition bath, and to maintain the quality of electrodeposition painting.

Specifically, concentrated solution having a high Na ion concentration is returned to the second water washing bath 12 by performing filtration by the second filtration membrane apparatus 18 which is a reverse osmosis membrane. As a result, Na ion concentration is accumulated in the electrodeposition bath 10. However, since it is possible to allow Na ions to escape to the filtrate side while the electrodeposition solution containing the accumulated Na ions is filtered by the first filtration membrane apparatus 16, it is possible to suppress an increase in the Na ion concentration of the electrodeposition solution in the electrodeposition bath 10. Further, it is possible to suppress an increase in the Na ion concentration in the whole system by adjusting the feed amount of filtrate of the second filtration membrane apparatus 18 the Na ion concentration of which has been reduced to the third water washing bath 13 and the feed amount of filtrate of the first filtration membrane apparatus 16 containing the Na ions of the electrodeposition solution in the electrodeposition bath 10 to the third water washing bath 13.

It is desirable that the flow rate adjustment unit 30 of the second embodiment also adjusts feed amount V1 of filtrate water obtained by filtration by the first filtration membrane apparatus 16 to the third water washing bath 13 and feed amount V2 of filtrate water obtained by filtration by the second filtration membrane apparatus 18 to the third water washing bath 13 so that V1:V2=1:2 through 2:1 is satisfied. It is more preferable that V1:V2=1:1 is satisfied. In the second embodiment, it is possible to lower the accumulation of Na ions in the electrodeposition bath 10 to 30 ppm or less, and to increase the paint recovery rate to 97.2% or higher by controlling the ratio of feed amount V1 of the filtrate water of the first filtration membrane apparatus 16 and feed amount V2 of the filtrate water of the second filtration membrane apparatus 18 in this manner.

Figure 4:
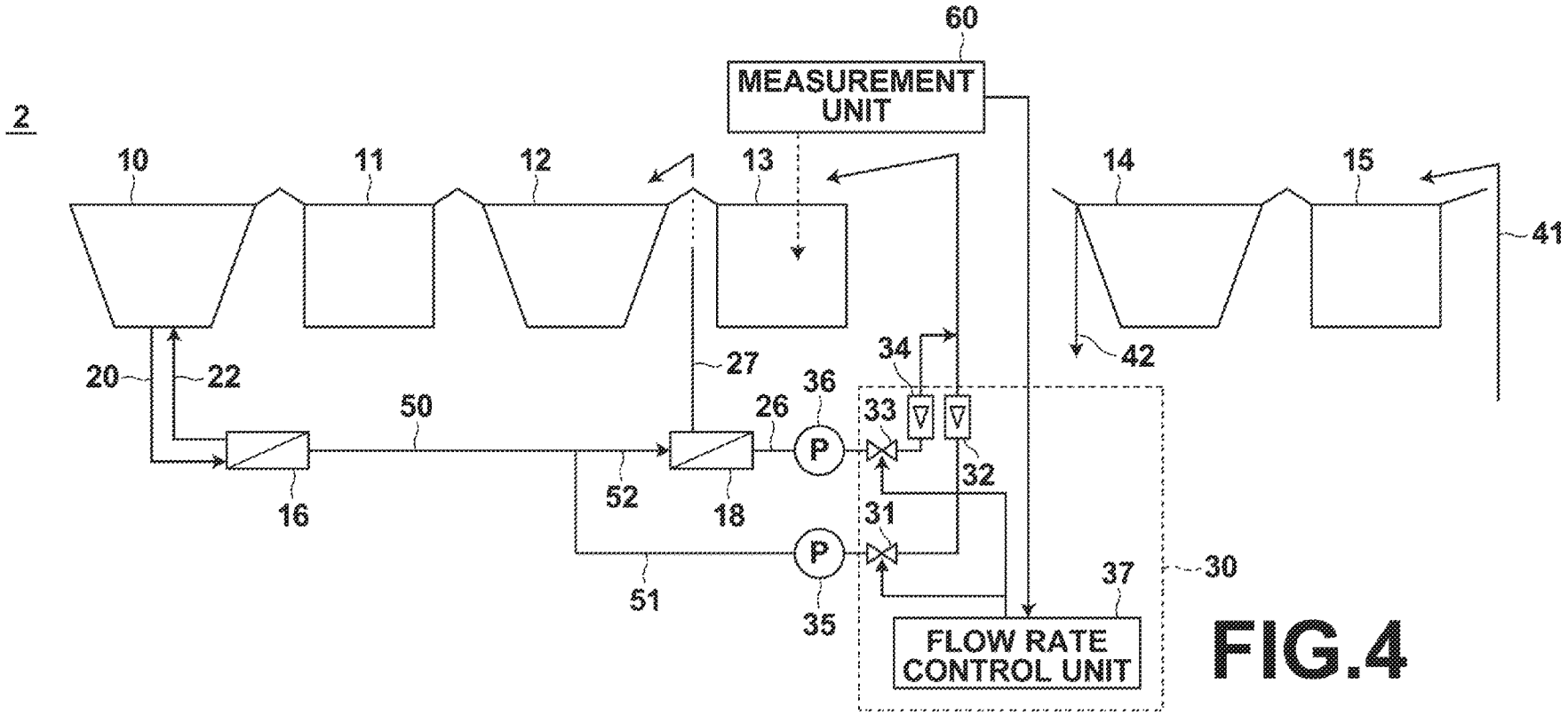
FIG. 4 A schematic diagram illustrating the configuration of the electrodeposition paint recovery system according to the second embodiment in a case where the feed amount of filtrate of the first filtration membrane apparatus to the water washing bath in the last stage and the feed amount of filtrate of the second filtration membrane to the water washing bath in the last stage are automatically adjusted.

In the first and second embodiments, the Na ion concentration of water for water washing in the first water washing bath 11 is reduced to 30 ppm or less by adjusting the ratio of feed amount V1 of filtrate water of the first filtration membrane apparatus 16 to the third water washing bath 13 and feed amount V2 of filtrate water of the second filtration membrane apparatus 18 to the third water washing bath 13. Alternatively, the Na ion concentration of water for water washing in the first water washing bath 11 may be reduced to 30 ppm or less by measuring a Na ion concentration and automatically adjusting, based on the measured value, feed amount V1 of filtrate water of the first filtration membrane apparatus 16 to the third water washing bath 13 and feed amount V2 of filtrate water of the second filtration membrane apparatus 18 to the third water washing bath 13. FIG. 4 is a schematic diagram illustrating the configuration of the electrodeposition paint recovery system 2 of the second embodiment in a case where feed amount V1 and feed amount V2 are automatically adjusted.

Specifically, as illustrated in FIG. 4, a measurement unit 60 that measures the electrical conductivity of water for water washing in the third water washing bath 13 and a flow rate control unit 37 that controls, based on the electrical conductivity measured by the measurement unit 60, a first valve mechanism 31 and a second valve mechanism 33 may be provided.

The measurement unit 60 measures the electrical conductivity of the water for water washing in the third water washing bath 13, as described above, and does not directly measure a Na ion concentration. However, since the Na ion concentration and the electrical conductivity have a correlation, it is possible to indirectly measure the Na ion concentration by measuring the electrical conductivity.

The flow rate control unit 37 automatically adjusts feed amount V1 and feed amount V2 by controlling the first valve mechanism 31 and the second valve mechanism 33, as described above. Specifically, the flow rate control unit 37 suppresses the Na ion concentration of water for water washing in the third water washing bath 13 so as to be within a predetermined threshold range by automatically adjusting feed amount V1 and feed amount V2 based on a variation in electrical conductivity measured by the measurement unit 60. As a result, the Na ion concentration of electrodeposition solution in the electrodeposition bath 10 is maintained at 30 ppm or less. Here, the relationship between a variation in electrical conductivity and adjustment amounts of feed amount V1 and feed amount V2 should be set in advance by experiment or the like.

In FIG. 4, the measurement 60 and the flow rate control unit 37 are provided for the electrodeposition paint recovery system 2 of the second embodiment. The measurement unit 60 and the flow rate control unit 37 may be provided for the electrodeposition paint recovery system 1 of the first embodiment.

Further, in the first and second embodiments, a reverse osmosis membrane is used as the filtration membrane of the second filtration membrane apparatus 18. It is preferable that the zeta potential of this reverse osmosis membrane is positive. It is possible to suppress adhesion of a resin component or the like contained in the filtrate of the third filtration membrane apparatus 17 of the first embodiment or the first filtration membrane apparatus 16 of the second embodiment to the reverse osmosis membrane by using the reverse osmosis membrane having positive zeta potential. For example, in a case where cationic paint having pH (potential hydrogen) of 5.0 through 6.0 is used as electrodeposition paint, it is possible to suppress adhesion of the electrodeposition paint to a reverse osmosis membrane by using the reverse osmosis membrane having positive zeta potential at pH of 5.0 through 6.0. As a result, it is possible to improve the recovery rate of electrodeposition paint, and also to prevent clogging of the reverse osmosis membrane.

The zeta potential is measurable by a zeta potential measurement apparatus (EKA (Electro Kinetic Analyzer) manufactured by Anton Paar GmbH). Specifically, in measurement of the zeta potential, first, a hollow fiber of a reverse osmosis membrane is cut to an appropriate length, and filled into a cylindrical cell having a diameter of 20 mm and a length of 50 mm. Further, electrodes are set to both ends of the cell, and the inside of the cell is filled with potassium chloride solution. Measurement is possible by applying an electric filed to the cell by the zeta potential measurement apparatus.

Here, a cationic reverse osmosis membrane is more preferable.

So far, an embodiment of the present disclosure has been described. However, the present disclosure is not limited to the embodiment, and may be modified without departing from the gist of the disclosure recited in each claim.

Example 1

Next, examples of the membrane filtration filtrate multistage recovery water washing step by the electrodeposition paint recovery system 1 of the first embodiment will be described. Table 1 shows examples in a case where feed amount V1 of filtrate water obtained by filtration by the first filtration membrane apparatus 16 to the third water washing bath 13 and feed amount V2 of filtrate water obtained by filtration by the second filtration membrane apparatus 18 to the third water washing bath 13 was V1:V2=1:1, in a case where V1:V2=1:1.5, in a case where V1:V2=1:2.0, in a case where V1:V2=1.5:1, and in a case where V1:V2=2:1. Here, KCV3010 (manufactured by Asahi Kasei Corporation) was used as hollow fiber modules of the first filtration membrane apparatus 16 and the third filtration membrane apparatus 17, and RE4040BLF (Woongjin Chemical Co., Ltd.) was used as a hollow fiber module of the second filtration membrane apparatus 18.

TABLE 1

| | PRE-TREAT-MENT | FIRST FIL-TRATION MEM-BRANE APPA-RATUS | THIRD FIL-TRATION MEM-BRANE APPA-RATUS | SECOND FIL-TRATION MEM-BRANE APPA-RATUS | ELECTRO-DEPO-SITION BATH | FIRST WATER WASH-ING BATH | SECOND WATER WASH-ING BATH | THIRD WATER WASH-ING BATH | FINAL WATER WASH-ING STEP | MAXI-MUM VALUE OF Na IONS | PAINT RECOV-ERY RATE |
|---|---|---|---|---|---|---|---|---|---|---|---|
| | | | | | V1:V2 = 1:1 | | | | | | |
| RAW WATER ppm | 6 | 9 | 10 | 10 | 9 | 10 | 10 | 6 | 6 | 16 ppm | 98% |
| FILTRATE LIQUID ppm | | 9.1 | 10 | 3 | | | | | | | |
| CONCEN-TRATED SOLU-TION ppm | | 9 | 10 | 29 | | | | | | | |
| FLOW RATE OF RAW WATER L/min | 10 | — | 95 | 80 | | | | | 10 | | |

TABLE 1-continued

| | PRE-TREAT-MENT | FIRST FIL-TRATION MEM-BRANE APPA-RATUS | THIRD FIL-TRATION MEM-BRANE APPA-RATUS | SECOND FIL-TRATION MEM-BRANE APPA-RATUS | ELECTRO-DEPO-SITION BATH | FIRST WATER WASH-ING BATH | SECOND WATER WASH-ING BATH | THIRD WATER WASH-ING BATH | FINAL WATER WASH-ING STEP | MAXI-MUM VALUE OF Na IONS | PAINT RECOV-ERY RATE |
|---|---|---|---|---|---|---|---|---|---|---|---|
| FLOW RATE OF FILTRATE L/min | | 60 | 80 | 60 | | | | | | | |
| FLOW RATE OF CON-CEN-TRATED SOLU-TION L/min | | — | 15 | 20 | | | | | | | |
| | | | | | V1:V2-1:1.5 | | | | | | |
| RAW WATER ppm | 6 | 10 | 11 | 11 | 10 | 11 | 11 | 6 | 6 | 18 ppm | 98.5% |
| FILTRATE LIQUID ppm | | 10.3 | 11 | 3 | | | | | | | |
| CONCEN-TRATED SOLU-TION ppm | | 10 | 11 | 29 | | | | | | | |
| FLOW RATE OF RAW WATER L/min | 10 | — | 155 | 130 | | | | | 10 | | |
| FLOW RATE OF FILTRATE L/min | | 60 | 130 | 90 | | | | | | | |
| FLOW RATE OF CONCEN-TRATED SOLU-TION L/min | | — | 25 | 40 | | | | | | | |
| | | | | | V1:V2 = 1:2 | | | | | | |
| RAW WATER ppm | 6 | 16 | 18 | 18 | 16 | 18 | 18 | 6 | 6 | 29 ppm | 99% |
| FILTRATE LIQUID ppm | | 16 | 18 | 3 | | | | | | | |
| CONCEN-TRATED SOLU-TION ppm | | 16 | 18 | 30 | | | | | | | |
| FLOW RATE OF RAW WATER L/min | 10 | — | 300 | 260 | | | | | 10 | | |
| FLOW RATE OF FILTRATE L/min | | 60 | 260 | 120 | | | | | | | |
| FLOW RATE OF CON-CEN-TRATED SOLU-TION L/min | | — | 40 | 140 | | | | | | | |

TABLE 1-continued

| | PRE-TREAT-MENT | FIRST FIL-TRATION MEM-BRANE APPA-RATUS | THIRD FIL-TRATION MEM-BRANE APPA-RATUS | SECOND FIL-TRATION MEM-BRANE APPA-RATUS | ELECTRO-DEPO-SITION BATH | FIRST WATER WASH-ING BATH | SECOND WATER WASH-ING BATH | THIRD WATER WASH-ING BATH | FINAL WATER WASH-ING STEP | MAXI-MUM VALUE OF Na IONS | PAINT RECOV-ERY RATE |
|---|---|---|---|---|---|---|---|---|---|---|---|
| | | | | | V1:V2 = 1.5:1 | | | | | | |
| RAW WATER ppm | 6 | 8.3 | 8.7 | 8.7 | 8.3 | 8.7 | 8.7 | 6 | 6 | 14 ppm | 97.7% |
| FILTRATE LIQUID ppm | | 8.3 | 8.7 | 3 | | | | | | | |
| CONCEN-TRATED SOLUTION ppm | | 8.3 | 8.7 | 20 | | | | | | | |
| FLOW RATE OF RAW WATER L/min | 10 | — | 80 | 60 | | | | | 10 | | |
| FLOW RATE OF FILTRATE L/min | | 60 | 60 | 40 | | | | | | | |
| FLOW RATE OF CON-CEN-TRATED SOLU-TION L/min | | — | 20 | 20 | | | | | | | |
| | | | | | V1:V2 = 2:1 | | | | | | |
| RAW WATER ppm | 6 | 7 | 7.2 | 7.2 | 7 | 7.2 | 7.2 | 6 | 6 | 12 ppm | 97.2% |
| FILTRATE LIQUID ppm | | 7 | 7.2 | 3 | | | | | | | |
| CONCEN-TRATED SOLU-TION ppm | | 7 | 7.2 | 19.9 | | | | | | | |
| FLOW RATE OF RAW WATER L/min | 10 | — | 50 | 40 | | | | | 10 | | |
| FLOW RATE OF FILTRATE L/min | | 60 | 40 | 30 | | | | | | | |
| FLOW RATE OF CON-CEN-TRATED SOLU-TION L/min | | — | 10 | 10 | | | | | | | |

Specifically, Table 1 shows the flow rate and Na ion concentration of raw water, the flow rate and Na ion concentration of filtrate water and the flow rate and Na ion concentration of concentrated solution at the first through third membrane filtration apparatuses 16, 18, 17, the Na ion concentration of electrodeposition solution in the electrodeposition bath 10, the Na ion concentration of water for water washing in the first water washing bath 11, the Na ion concentration of water for water washing in the second water washing bath 12, and the Na ion concentration of water for water washing in the third water washing bath 13 in cases where the membrane filtration filtrate multistage recovery water washing step was performed at the aforementioned ratios. In each table of Table 1, the first through third rows excluding the title row show Na ion concentrations (ppm), and the fourth through sixth rows show the flow rates (L/min) of raw water, filtrate and concentrated solution.

Figure 5:
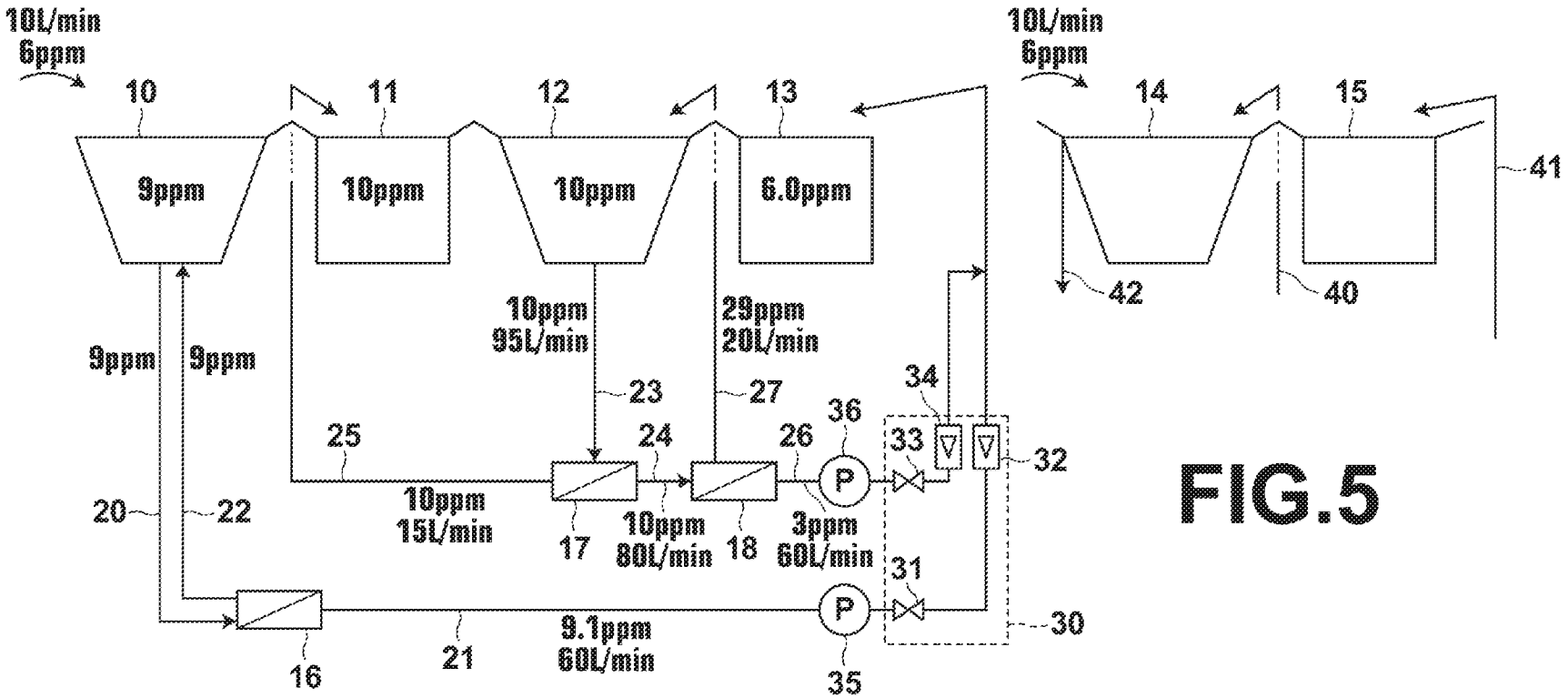
FIG. 5 A diagram illustrating a flow rate and a Na ion concentration of each unit in the electrodeposition paint recovery system according to the first embodiment in a case where the ratio of feed amount V of the filtrate obtained by filtration by the first filtration membrane to the water washing bath in the last stage and feed amount V2 of the filtrate obtained by filtration by the second filtration membrane to the water washing bath in the last stage is 1:1.

Further, FIG. 5 shows the flow rate and Na ion concentration of each unit in the case of V1:V2=1:1 in Table 1.

The Na ion concentrations shown in Table 1 are average values of Na ion concentrations after each washing process in a case where plural painted objects were washed plural times at flow rates shown in Table 1.

Further, the "PRE-TREATMENT" shown in Table 1 is a treatment performed on an object to be painted before the object to be painted is brought into the electrodeposition bath 10. As this "PRE-TREATMENT", there are a degreasing step of removing oil and fat adhered to the surface of the object to be painted, and a chemical conversion treatment step of performing, on the object to be painted, surface treatment for making electrodeposition paint adhere to the object to be painted. Further, NaOH or Na salt added as a degreasing agent in the degreasing step adheres to the object to be painted, and is brought into the electrodeposition bath 10. The "FLOW RATE OF RAW WATER" and the Na ion concentration of "RAW WATER" in the "PRE-TREATMENT" shown in Table 1 are the average value of flow rates and the average value of Na ion concentrations of liquid containing NaOH or Na salt that adhered to the object to be painted and was brought into the electrodeposition bath 10 while the object to be painted is put in the electrodeposition bath 10. In the examples shown in Table 1, the average value of the flow rates of liquid that adhered to the object to be painted and was brought into the electrodeposition bath 10 was 10 L/min, and the average value of Na ion concentrations of the liquid was 6 ppm, and the maximum value of Na ion concentration was 10 ppm. Here, the average value of Na ion concentrations of liquid that adhered to the object to be painted and was brought into the electrodeposition bath 10 was less than or equal to the Na ion concentration of electrodeposition solution in the electrodeposition bath 10.

Further, the flow rate and the Na ion concentration in the "FINAL WASHING STEP" shown in Table 1 are the average value of flow rates and the average of Na ion concentrations of water for water washing brought into the fourth water washing bath 14 together with the painted object while the painted object was brought into the fourth water washing bath 14 in the final washing step from the third water washing bath 13. In the examples shown in Table 1, the average value of the flow rates of water for water washing brought into the final washing step was 10 L/min, and the average value of Na ion concentrations was 6 ppm.

Further, in a case where the membrane filtration filtrate multistage recovery water washing step was performed at each flow rate shown in Table 1 and FIG. 5 by adjusting the ratio of V1:V2 to 1:1, the Na ion concentration of water for water washing in the first water washing bath 11 was the highest, and the average value of Na ion concentrations was 10 ppm. Further, even in the case where the maximum value of the Na ion concentration of chemical conversion treatment solution brought from the pre-treatment was 10 ppm, the maximum value of the Na ion concentration of water for water washing in the first water washing bath 11 was 16 ppm. In other words, the Na ion concentration of the electrodeposition bath 11 was maintainable at 30 ppm or less.

Next, a method for measuring a Na ion concentration in the present example will be described.

First, centrifugation was performed on electrodeposition solution or water for water washing that included paint and pigment, and its supernatant liquid was used as a sample. The centrifugation was performed at 15000 rpm for 20 minutes. Further, centrifugation was not performed on water for water washing that contained no pigment, and the water for water washing was directly used as a sample. The sample was placed in a 20 cc bottle made of polyethylene, and diluted with pure water so as to be within the calibration curve of Na ion standard solution.

2.5 ml of nitric acid at 60% was added to 50 ml of the sample prepared as described above, and thermolysis was performed at 150° C. on a hot plate. After then, the volume of the solution was adjusted to 50 ml after the solution was allowed to cool, and the solution was used as a test solution.

Then, a Na ion concentration was measured by using an ICP (Inductively Coupled Plasma) optical emission spectroscopy method. As a measurement apparatus, Optima 5300 DV manufactured by PerkinElmer Co., Ltd. was used. Further, a measurement wavelength was 589.592 nm, and an output was 1300 kw. Argon gas was used as feed gas, and the observation direction of plasma was a radial direction. The test solution was measured, and if the Na ion concentration was a value on the calibration curve or higher, the test solution was diluted so as to be within the range of the calibration curve, and measurement was performed again.

Back to Table 1, in the case where V1:V2 was adjusted to 1:1, and the membrane filtration filtrate multistage recovery water washing step and the final water washing step were performed, the paint recovery rate was 98%. The paint recovery rate was calculated by using the following expression. NV (Non-Volatile) (paint remained after heating) in the following expression was measured by JISK5601-1-2:

$$\text{Paint Recovery Rate}=(1-(NV\text{ of Third Water Washing Bath13}/NV\text{ of Electrodeposition Bath 10}))\times 100.$$

Further, as shown in Table 1, in the case where V1:V2 was adjusted to 1:1.5, and the membrane filtration filtrate multistage recovery water washing step was performed, the average value of the Na ion concentrations of the water for water washing in the first water washing bath 11 was 11 ppm. Further, even in the case where the maximum value of the Na ion concentration of chemical conversion treatment solution brought from pre-treatment was 10 ppm, the maximum value of the Na ion concentration of water for water washing in the first water washing bath 11 was 18 ppm. In other words, it was possible to maintain the Na ion concentration of the electrodeposition bath 10 at 30 ppm or less. Further, the paint recovery rate was 98.5%.

Further, as shown in Table 1, in the case where V1:V2 was adjusted to 1:2.0, and the membrane filtration filtrate multistage recovery water washing step was performed, the average value of the Na ion concentrations of the water for water washing in the first water washing bath 11 was 18 ppm. Further, even in the case where the maximum value of the Na ion concentration of chemical conversion treatment solution brought from pre-treatment was 10 ppm, the maximum value of the Na ion concentration of water for water washing in the first water washing bath 11 was 29 ppm. In other words, it was possible to maintain the Na ion concentration of the electrodeposition bath 10 at 30 ppm or less. Further, the paint recovery rate was 99%.

Further, as shown in Table 1, in the case where V1:V2 was adjusted to 1.5:1, and the membrane filtration filtrate multistage recovery water washing step was performed, the average value of the Na ion concentrations of the water for water washing in the first water washing bath 11 was 8.7 ppm. Further, even in the case where the maximum value of the Na ion concentration of chemical conversion treatment solution brought from pre-treatment was 10 ppm, the maximum value of the Na ion concentration of water for water washing in the first water washing bath 11 was 14 ppm. In other words, it was possible to maintain the Na ion concentration of the electrodeposition bath 10 at 30 ppm or less. Further, the paint recovery rate was 97.7%.

Further, as shown in Table 1, in the case where V1:V2 was adjusted to 2:1, and the membrane filtration filtrate multistage recovery water washing step was performed, the average value of the Na ion concentrations of the water for water washing in the first water washing bath 11 was 7.2 ppm. Further, even in the case where the maximum value of the Na ion concentration of chemical conversion treatment solution brought from pre-treatment was 10 ppm, the maximum value of the Na ion concentration of water for water washing in the first water washing bath 11 was 12 ppm. In other words, it was possible to maintain the Na ion concentration of the electrodeposition bath 10 at 30 ppm or less. Further, the paint recovery rate was 97.2%.

According to the results of the examples shown in Table 1, it was possible to maintain the Na ion concentration of the electrodeposition bath 10 at 30 ppm or less in the case of V1:V2=1:2 through 2:1, and to increase the paint recovery rate to 97.2% or higher.

Next, Table 2 shows comparative example, and shows the flow rate and Na ion concentration of each unit in the case of V1:V2=1:0 and in the case of V1:V2=1:2.1. Here, the meaning of the "FLOW RATE OF RAW WATER" and the meaning of the Na ion concentration of the "RAW WATER" in the "PRE-TREATMENT" and the "FINAL WASHING STEP" shown in Table 2 are similar to the aforementioned examples. Further, the methods for measuring the Na ion concentration and NV are also similar to the examples.

TABLE 2

| | PRE-TREATMENT | FIRST FILTRATION MEMBRANE APPARATUS | THIRD FILTRATION MEMBRANE APPARATUS | SECOND FILTRATION MEMBRANE APPARATUS | ELECTRODEPOSITION BATH | FIRST WATER WASHING BATH | SECOND WATER WASHING BATH | THIRD WATER WASHING BATH | FINAL WATER WASHING STEP | MAXIMUM VALUE OF Na IONS | PAINT RECOVERY RATE |
|---|---|---|---|---|---|---|---|---|---|---|---|
| V1:V2 = 1:0 | | | | | | | | | | | |
| RAW WATER Ppm | 6 | 6.2 | 6 | 0 | 6.2 | 6.2 | 6.2 | 6 | 6 | 10 ppm | 95.4% |
| FILTRATE LIQUID Ppm | | 6.2 | 6 | 0 | | | | | | | |
| CONCENTRATED SOLUTION ppm | | 6.2 | 6 | 0 | | | | | | | |
| FLOW RATE OF RAW WATER L/min | 10 | — | 0 | 0 | | | | | 10 | | |
| FLOW RATE OF FILTRATE L/min | | 60 | 0 | 0 | | | | | | | |
| FLOW RATE OF CONCENTRATED SOLUTION L/min | | — | 0 | 0 | | | | | | | |
| V1:V2 = 1:2.1 | | | | | | | | | | | |
| RAW WATER Ppm | 6 | 18 | 20 | 20 | 18 | 20 | 20 | 6 | 6 | 34 ppm | 99.5% |
| FILTRATE LIQUID Ppm | | 18.1 | 20 | 3 | | | | | | | |
| CONCENTRATED SOLUTION ppm | | 18 | 20 | 36 | | | | | | | |
| FLOW RATE OF RAW WATER L/min | 10 | — | 306 | 266 | | | | | 10 | | |
| FLOW RATE OF FILTRATE L/min | | 60 | 266 | 126 | | | | | | | |
| FLOW RATE OF CONCENTRATED SOLUTION L/min | | — | 40 | 140 | | | | | | | |

As shown in Table 2, in the case where V1:V2 was adjusted to 1:0, and the membrane filtration filtrate multi-stage recovery water washing step was performed, in other words, in the case where only the filtrate water of the first filtration membrane apparatus 16 was fed to the third water washing bath 13, the average value of the Na ion concentrations of the water for water washing in the first water washing bath 11 was 6.2 ppm. Further, even in the case where the maximum value of the Na ion concentration of chemical conversion treatment solution brought from pre-treatment was 10 ppm, the maximum value of the Na ion concentration of water for water washing in the first water washing bath 11 was 10 ppm. In other words, it was possible to maintain the Na ion concentration at 30 ppm or less. However, since the effect of recovering non-electrodeposited paint by the second filtration membrane apparatus 18 was not achievable, the paint recovery rate was 95.4%, which was an extremely low value, compared with the examples.

As shown in Table 2, in the case where V1:V2 was adjusted to 1:2.1, and the membrane filtration filtrate multistage recovery water washing step was performed, in other words, in the case where the feed amount of the filtrate of the second filtration membrane apparatus 18 was increased to at least twice the feed amount of the filtrate of the first filtration membrane apparatus 16, the return amount of concentrated solution containing Na ions also increased. As a result, the average value of the Na ion concentrations of the water for water washing in the first water washing bath 11 was 20 ppm. Further, in the case where the maximum value of the Na ion concentration of chemical conversion treatment solution brought from pre-treatment was 10 ppm, the maximum value of the Na ion concentration of water for water washing in the first water washing bath 11 was 34 ppm. In other words, it was found that the Na ion concentration of the electrodeposition bath 10 exceeded 30 ppm if washing was continued. However, the paint recovery rate was 99.5%.

Next, examples of the membrane filtration filtrate multi-stage recovery water washing step by the electrodeposition paint recovery system 2 of the second embodiment will be described. Table 3 shows examples in a case where feed amount V1 of filtrate water obtained by filtration by the first filtration membrane apparatus 16 to the third water washing bath 13 and feed amount V2 of filtrate water obtained by filtration by the second filtration membrane apparatus 18 to the third water washing bath 13 was V1:V2=1:1, in a case where V1:V2-1:1.5, in a case where V1:V2=1:2.0, in a case where V1:V2=1.5:1, and in a case where V1:V2=2:1. Here, KCV3010 (manufactured by Asahi Kasei Corporation) was used as a hollow fiber module of the first filtration membrane apparatus 16, and RE4040BLF (Woongjin Chemical Co., Ltd.) was used as a hollow fiber module of the second filtration membrane apparatus 18.

TABLE 3

| | PRE-TREAT-MENT | FIRST FIL-TRATION MEM-BRANE APPA-RATUS | FLOW PATH 51 | SECOND FIL-TRATION MEM-BRANE APPA-RATUS | ELECTRO-DEPO-SITION BATH | FIRST WATER WASH-ING BATH | SECOND WATER WASH-ING BATH | THIRD WATER WASH-ING BATH | POST TREAT-MENT | MAXI-MUM VALUE OF Na IONS | PAINT RECOV-ERY RATE |
|---|---|---|---|---|---|---|---|---|---|---|---|
| V1:V2 = 1:1 | | | | | | | | | | | |
| RAW WATER ppm | 6 | 9 | — | 9 | 9 | 10 | 10 | 6 | 6 | 16 ppm | 98% |
| FILTRATE LIQUID ppm | | 9 | 9 | 3 | | | | | | | |
| CONCEN-TRATED SOLU-TION ppm | | 9 | — | 27 | | | | | | | |
| FLOW RATE OF RAW WATER L/min | 10 | — | — | 80 | | | | | 10 | | |
| FLOW RATE OF FILTRATE/ min | | 140 | 60 | 60 | | | | | | | |
| FLOW RATE OF CON-CEN-TRATED SOLU-TION L/min | | — | — | 20 | | | | | | | |
| V1:V2 = 1:1.5 | | | | | | | | | | | |
| Raw WATER ppm | 6 | 10 | — | 10 | 10 | 11 | 11 | 6 | 6 | 18 ppm | 98.5% |
| FILTRATE LIQUID ppm | | 10 | 10 | 3 | | | | | | | |

TABLE 3-continued

| | PRE-TREAT-MENT | FIRST FIL-TRATION MEM-BRANE APPA-RATUS | FLOW PATH 51 | SECOND FIL-TRATION MEM-BRANE APPA-RATUS | ELECTRO-DEPO-SITION BATH | FIRST WATER WASH-ING BATH | SECOND WATER WASH-ING BATH | THIRD WATER WASH-ING BATH | POST TREAT-MENT | MAXI-MUM VALUE OF Na IONS | PAINT RECOV-ERY RATE |
|---|---|---|---|---|---|---|---|---|---|---|---|
| CONCEN-TRATED SOLU-TION ppm | | 10 | — | 27 | | | | | | | |
| FLOW RATE OF RAW WATER L/min | 10 | — | — | 130 | | | | | 10 | | |
| FLOW RATE OF FILTRATE L/min | | 190 | 60 | 90 | | | | | | | |
| FLOW RATE OF CON-CEN-TRATED SOLU-TION L/min | | — | — | 40 | | | | | | | |
| | | | | | V1:V2 = 1:2.0 | | | | | | |
| RAW WATER ppm | 6 | 16 | — | 16 | 16 | 18 | 18 | 6 | 6 | 29 ppm | 99% |
| FTLTRATE LIQUID ppm | | 16 | 16 | 3 | | | | | | | |
| CONCEN-TRATED SOLU-TION ppm | | 16 | — | 27 | | | | | | | |
| FLOW RATE OF RAW WATER L/min | 10 | — | — | 260 | | | | | 10 | | |
| FLOW RATE OF FILTRATE L/min | | 320 | 60 | 120 | | | | | | | |
| FLOW RATE OF CON-CEN-TRATED SOLU-TION L/min | | — | — | 140 | | | | | | | |
| | | | | | V1:V2 = 1.5:1 | | | | | | |
| RAW WATER ppm | 6 | 8.3 | — | 8.3 | 8.3 | 8.7 | 8.7 | 6 | 6 | 14 ppm | 97.7% |
| FILTRATE LIQUID ppm | | 8.3 | 8.3 | 3 | | | | | | | |
| CONCEN-TRATED SOLU-TION ppm | | 8.3 | — | 18.8 | | | | | | | |
| FLOW RATE OF RAW WATER L/min | 10 | — | — | 60 | | | | | 10 | | |
| FLOW RATE OF FILTRATE L/min | | 120 | 60 | 40 | | | | | | | |

TABLE 3-continued

| | PRE-TREAT-MENT | FIRST FIL-TRATION MEM-BRANE APPA-RATUS | FLOW PATH 51 | SECOND FIL-TRATION MEM-BRANE APPA-RATUS | ELECTRO-DEPO-SITION BATH | FIRST WATER WASH-ING BATH | SECOND WATER WASH-ING BATH | THIRD WATER WASH-ING BATH | POST TREAT-MENT | MAXI-MUM VALUE OF Na IONS | PAINT RECOV-ERY RATE |
|---|---|---|---|---|---|---|---|---|---|---|---|
| FLOW RATE OF CON-CEN-TRATED SOLU-TION L/min | | — | — | 20 | | | | | | | |
| | | | | | V1:V2 = 2.0:1 | | | | | | |
| RAW WATER ppm | 6 | 7 | — | 7 | 7 | 7.2 | 7.2 | 6 | 6 | 12 ppm | 97.2% |
| FILTRATE LIQUID ppm | | 7 | 7 | 3 | | | | | | | |
| CONCEN-TRATED SOLU-TION ppm | | 7 | — | 19.2 | | | | | | | |
| FLOW RATE OF RAW WATER L/min | 10 | — | — | 40 | | | | | 10 | | |
| FLOW RATE OF FILTRATE L/min | | 100 | 60 | 30 | | | | | | | |
| FLOW RATE OF CON-CEN-TRATED SOLU-TION L/min | | — | — | 10 | | | | | | | |

Table 3 shows the flow rate and Na ion concentration of raw water, the flow rate and Na ion concentration of filtrate water, the flow rate and Na ion concentration of concentrated solution at the first and second membrane filtration apparatuses 16 and 18, the flow rate and Na ion concentration of filtrate water in the flow path 51, the Na ion concentration of electrodeposition solution in the electrodeposition bath 10, the Na ion concentration of water for water washing in the first water washing bath 11, the Na ion concentration of water for water washing in the second water washing bath 12, and the Na ion concentration of water for water washing in the third water washing bath 13 in the first and second membrane filtration apparatuses 16 and 18 in cases where the membrane filtration filtrate multistage recovery water washing step was performed at each of the aforementioned ratios.

Figure 6:
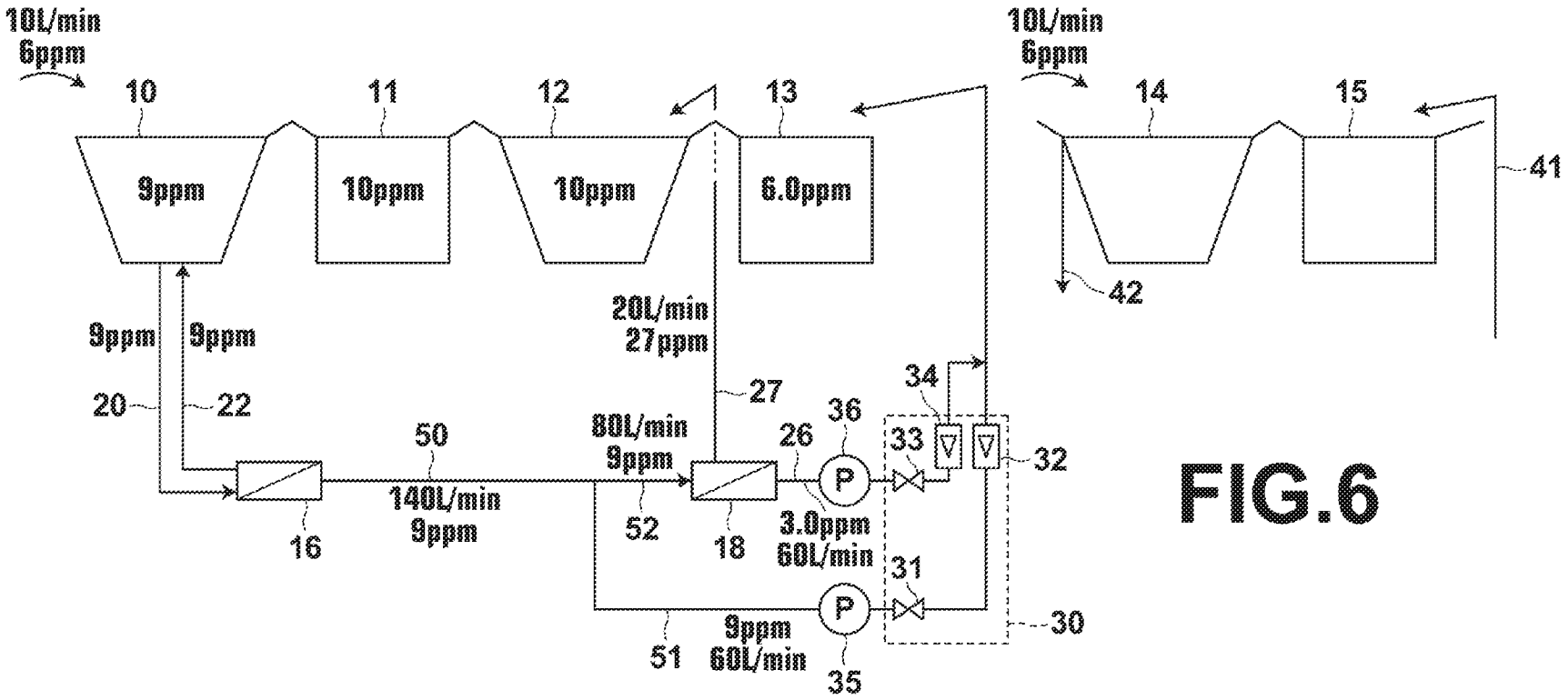
FIG. 6 A diagram illustrating a flow rate and a Na ion concentration of each unit in the electrodeposition paint recovery system according to the second embodiment in a case where the ratio of feed amount V1 of the filtrate obtained by filtration by the first filtration membrane to the water washing bath in the last stage and feed amount V2 of the filtrate obtained by filtration by the second filtration membrane to the water washing bath in the last stage is 1:1.
Figure 8:
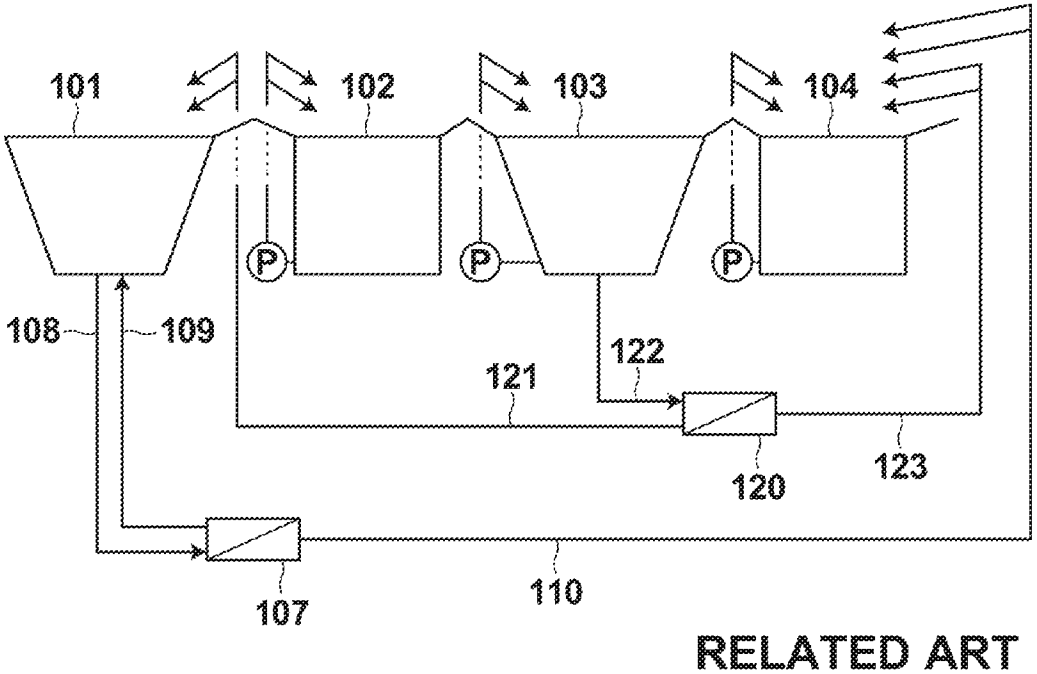
FIG.8 RELATED ART
FIG. 8 A diagram illustrating an example of a conventional electrodeposition paint recovery system.

Further, FIG. 6 shows each of the flow rate and Na ion concentration of each unit in the case of V1:V2=1:1 in Table 3.

The Na ion concentrations shown in Table 3 are average values of Na ion concentrations after each washing process in a case where plural painted objects were washed at flow rates shown in Table 3 in a similar manner to the first embodiment. Here, the meaning of the flow rate and the meaning of the Na ion concentration in the "PRE-TREATMENT" and the "FINAL WASHING STEP" shown in Table 3 are also similar to the examples in the first embodiment. Further, the methods for measuring the Na ion concentration and NV are also similar to the examples in the first embodiment.

Further, in the case where V1:V2 was adjusted to 1:1 at each of the flow rates shown in Table 3 and FIG. 6, and the membrane filtration filtrate multistage recovery water washing step was performed, the Na ion concentration of the water for water washing in the first water washing bath 11 was highest, and the average value of Na ion concentrations was 10 ppm. Further, even in the case where the maximum value of the Na ion concentration of chemical conversion treatment solution brought from pre-treatment was 10 ppm, the maximum value of the Na ion concentration of water for water washing in the first water washing bath 11 was 16 ppm. In other words, it was possible to maintain the Na ion concentration of the electrodeposition bath 10 at 30 ppm or less.

Further, in the case where V1:V2 was adjusted to 1:1.5 as shown in Table 3, and the membrane filtration filtrate multistage recovery water washing step was performed, the average value of Na ion concentrations of the water for water washing in the first water washing bath 11 was 11 ppm. Further, even in the case where the maximum value of the Na ion concentration of chemical conversion treatment solution brought from pre-treatment was 10 ppm, the maximum value of the Na ion concentration of water for water washing in the first water washing bath 11 was 18 ppm. In other words, it was possible to maintain the Na ion concentration of the electrodeposition bath 10 at 30 ppm or less. Further, the paint recovery rate was 98.5%.

Further, in the case where V1:V2 was adjusted to 1:2.0 as shown in Table 3, and the membrane filtration filtrate multistage recovery water washing step was performed, the average value of Na ion concentrations of the water for water washing in the first water washing bath 11 was 18 ppm. Further, even in the case where the maximum value of the Na ion concentration of chemical conversion treatment solution brought from pre-treatment was 10 ppm, the maximum value of the Na ion concentration of water for water washing in the first water washing bath 11 was 29 ppm In other words, it was possible to maintain the Na ion concentration of the electrodeposition bath 10 at 30 ppm or less. Further, the paint recovery rate was 99%.

Further, in the case where V1:V2 was adjusted to 1.5:1 as shown in Table 3, and the membrane filtration filtrate multistage recovery water washing step was performed, the average value of Na ion concentrations of the water for water washing in the first water washing bath 11 was 8.7 ppm Further, even in the case where the maximum value of the Na ion concentration of chemical conversion treatment solution brought from pre-treatment was 10 ppm, the maximum value of the Na ion concentration of water for water washing in the first water washing bath 11 was 14 ppm. In other words, it was possible to maintain the Na ion concentration of the electrodeposition bath 10 at 30 ppm or less. Further, the paint recovery rate was 97.7%.

Further, in the case where V1:V2 was adjusted to 2:1 as shown in Table 3, and the membrane filtration filtrate multistage recovery water washing step was performed, the average value of Na ion concentrations of the water for water washing in the first water washing bath 11 was 7.2 ppm. Further, even in the case where the maximum value of the Na ion concentration of chemical conversion treatment solution brought from pre-treatment was 10 ppm, the maximum value of the Na ion concentration of water for water washing in the first water washing bath 11 was 12 ppm. In other words, it was possible to maintain the Na ion concentration of the electrodeposition bath 10 at 30 ppm or less. Further, the paint recovery rate was 97.2%.

According to the results of the examples shown in Table 3, it was possible to maintain the Na ion concentration of the electrodeposition bath 10 at 30 ppm or less in the case of V1:V2=1:2 through 2:1, and to increase the paint recovery rate to 97.2% or higher also in the electrodeposition paint recovery system 2 of the second embodiment.

Next, Table 4 shows comparative examples, and shows the flow rate and Na ion concentration of each unit in the case of V1:V2=1:0 and in the case of V1:V2=1:2.1. Here, the meaning of the flow rate and the meaning of the Na ion concentration in the "PRE-TREATMENT" and the "FINAL WASHING STEP" shown in Table 4 are also similar to the aforementioned examples. Further, the methods for measuring the Na ion concentration and NV are also similar to the examples.

TABLE 4

| | PRE-TREAT-MENT | FIRST FIL-TRATION MEM-BRANE APPA-RATUS | FLOW PATH 51 | SECOND FIL-TRATION MEM-BRANE APPA-RATUS | ELECTRO-DEPO-SITION BATH | FIRST WATER WASH-ING BATH | SECOND WATER WASH-ING BATH | THIRD WATER WASH-ING BATH | POST TREAT-MENT | MAXI-MUM VALUE OF Na IONS | PAINT RECOV-ERY RATE |
|---|---|---|---|---|---|---|---|---|---|---|---|
| | | | | | V1:V2 = 1:0 | | | | | | |
| RAW WATER ppm | 6 | 6 | — | 0 | 6.2 | 6.2 | 6.2 | 6 | 6 | 10 ppm | 95.4% |
| FILTRATE LIQUID ppm | | 6 | 6 | 0 | | | | | | | |
| CONCEN-TRATED SOLU-TION ppm | | 6 | — | 0 | | | | | | | |
| FLOW RATE OF RAW WATER L/min | 10 | — | — | 0 | | | | | 10 | | |
| FLOW RATE OF FILTRATE L/min | | 60 | 60 | 0 | | | | | | | |
| FLOW RATE OF CON-CEN-TRATED SOLU-TION L/min | | — | — | 0 | | | | | | | |

TABLE 4-continued

| | PRE-TREAT-MENT | FIRST FIL-TRATION MEM-BRANE APPA-RATUS | FLOW PATH 51 | SECOND FIL-TRATION MEM-BRANE APPA-RATUS | ELECTRO-DEPO-SITION BATH | FIRST WATER WASH-ING BATH | SECOND WATER WASH-ING BATH | THIRD WATER WASH-ING BATH | POST TREAT-MENT | MAXI-MUM VALUE OF Na IONS | PAINT RECOV-ERY RATE |
|---|---|---|---|---|---|---|---|---|---|---|---|
| | | | | | V1:V2 = 1:2.1 | | | | | | |
| RAW WATER Ppm | 6 | 18 | — | 18 | 18 | 20 | 20 | 6 | 6 | 34 ppm | 99.5% |
| FILTRATE LIQUID Ppm | | 18 | 18 | 3 | | | | | | | |
| CONCEN-TRATED SOLUTION Ppm | | 18 | — | 32 | | | | | | | |
| FLOW RATE OF RAW WATER L/min | 10 | — | — | 266 | | | | | 10 | | |
| FLOW RATE OF FILTRATE L/min | | 326 | 60 | 126 | | | | | | | |
| FLOW RATE OF CON-CEN-TRATED SOLUTION L/min | | — | — | 140 | | | | | | | |

As shown in Table 4, in the case where V1:V2 was adjusted to 1:0, and the membrane filtration filtrate multi-stage recovery water washing step was performed, in other words, in the case where only the filtrate water on the flow path 51 side was fed to the third water washing bath 13, the average value of the Na ion concentrations of the water for water washing in the first water washing bath 11 was 6.2 ppm. Further, even in the case where the maximum value of the Na ion concentration of chemical conversion treatment solution brought from pre-treatment was 10 ppm, the maximum value of the Na ion concentration of water for water washing in the first water washing bath 11 was 10 ppm. In other words, it was possible to maintain the Na ion concentration at 30 ppm or less. However, since the effect of recovering non-electrodeposited paint by the second filtration membrane apparatus 18 was not achievable, the paint recovery rate is 95.4%, which was an extremely low value, compared with the examples.

Further, as shown in Table 4, in the case where V1:V2 was adjusted to 1:2.1, and the membrane filtration filtrate multistage recovery water washing step was performed, in other words, in the case where the feed amount of the filtrate of the second filtration membrane apparatus 18 was increased to at least twice the feed amount of the filtrate of the first filtration membrane apparatus 16, the return amount of concentrated solution containing Na ions also increased. As a result, the average value of the Na ion concentrations of the water for water washing in the first water washing bath 11 was 20 ppm. Further, in the case where the maximum value of the Na ion concentration of chemical conversion treatment solution brought from pre-treatment was 10 ppm, the maximum value of the Na ion concentration of water for water washing in the first water washing bath 11 was 34 ppm. In other words, it was found that the Na ion concentration of the electrodeposition bath 10 exceeded 30 ppm if washing was continued. Meanwhile, the paint recovery rate was 99.5%.

The invention claimed is:

1. An electrodeposition paint recovery system, comprising at least two water washing baths in which the object to be painted after electrodeposition painting is washed stepwise with water;

a first filtration membrane which is an ultrafiltration membrane or a microfiltration membrane, and which feeds filtrate obtained by filtering an electrodeposition solution that contains an electrodeposition paint within the electrodeposition bath to a water washing bath at a last stage from among the at least two water washing baths and a second filtration membrane which is connected at a downstream position, and feeds a concentrated solution to the electrodeposition bath, respectively;

the second filtration membrane which is a reverse osmosis membrane, and which feeds filtrate obtained by filtering the filtrate water fed by the first filtration membrane to the water washing bath of the last stage, and feeds a concentrated solution to one of the electrodeposition bath and a water washing bath other than the water washing bath of the last stage, respectively; and a flow rate adjustment unit that adjusts a feed amount of each of the filtrate obtained by filtration by the first filtration membrane and the filtrate obtained by filtration by the second filtration membrane to the water washing bath of the last stage, wherein water after water washing is fed from the water washing bath of the last stage sequentially in order from the water washing bath or baths located more toward the electrodeposition bath than the water washing bath of the last stage to the electrodeposition bath.

2. An electrodeposition paint recovery system comprising:

an electrodeposition bath in which electrodeposition painting is performed on an object to be painted;

at least two water washing baths in which the object to be painted after electrodeposition painting is washed stepwise with water;

a first filtration membrane which is an ultrafiltration membrane or a microfiltration membrane, and which feeds filtrate obtained by filtering an electrodeposition solution that contains an electrodeposition paint within the electrodeposition bath to the water washing bath at a last stage from among the at least two water washing baths, and feeds a concentrated solution to the electrodeposition bath, respectively;

a third filtration membrane which is an ultrafiltration membrane or a microfiltration membrane, and which feeds filtrate obtained by filtering water in one of the at least two water washing baths after washing to a second filtration membrane which is connected at a later step, and feeds a concentrated solution to a water washing bath located more toward the electrodeposition bath side than the one water washing bath or to the electrodeposition bath;

the second filtration membrane which is a reverse osmosis membrane, and which feeds filtrate obtained by filtering the filtrate water fed by the third filtration membrane to the water washing bath of the last stage, and feeds a concentrated solution to one of the electrodeposition bath and a water washing bath other than the water washing bath of the last stage, respectively; and a flow rate adjustment unit that adjusts a feed amount of each of the filtrate obtained by filtration by the first filtration membrane and the filtrate obtained by filtration by the second filtration membrane to the water washing bath of the last stage, wherein water after water washing is fed from the water washing bath of the last stage sequentially in order from the water washing bath or baths located more toward the electrodeposition bath than the water washing bath of the last stage to the electrodeposition bath.

3. The electrodeposition paint recovery system, as defined in either one of claim 2 and claim 1, wherein the flow rate adjustment unit adjusts the feed amount so that ratio V1:V2 of feed amount V1 of the filtrate obtained by filtration by the first filtration membrane to the water washing bath of the last stage and feed amount V2 of the filtrate obtained by filtration by the second filtration membrane to the water washing bath of the last stage becomes 1:2 through 2:1.

4. The electrodeposition paint recovery system, as defined in claim 3, wherein the flow rate adjustment unit adjusts the feed amount so that the ratio V1:V2 becomes 1:1.

5. The electrodeposition paint recovery system, as defined in either one of claim 2 and claim 1, wherein the flow rate adjustment unit adjusts the feed amount of the filtrate obtained by filtration by the first filtration membrane to the water washing bath of the last stage and the feed amount of the filtrate obtained by filtration by the second filtration membrane to the water washing bath of the last stage so that a Na ion concentration of water after water washing in a water washing bath closest to the electrodeposition bath from among the at least two water washing baths is 30 ppm or less.

6. The electrodeposition paint recovery system, as defined in claim 5, the system further comprising:

a measurement unit that measures the electrical conductivity of water after water washing in the water washing bath of the last stage, wherein the flow rate adjustment unit automatically adjusts, based on the electrical conductivity measured by the measurement unit, the feed amount of the filtrate obtained by filtration by the first filtration membrane to the water washing bath of the last stage and the feed amount of the filtrate obtained by filtration by the second filtration membrane to the water washing bath of the last stage.

7. The electrodeposition paint recovery system, as defined in either one of claim 2 and claim 1, wherein the second filtration membrane has a positive zeta potential.

8. An electrodeposition paint recovery method, wherein an electrodeposition bath in which electrodeposition painting is performed on an object to be painted, at least two water washing baths in which the object to be painted after electrodeposition painting is washed stepwise with water, and a first filtration membrane which is an ultrafiltration membrane or a microfiltration membrane, and which feeds filtrate obtained by performing filtration on electrodeposition solution containing electrodeposition paint in the electrodeposition bath to a washing bath at a last stage from among the at least two water washing baths and feeds a concentrated solution to the electrodeposition bath, are used and water after water washing is fed from the water washing bath of the last stage sequentially in order from the water washing bath or baths located more toward the electrodeposition bath than the water washing bath of the last stage to the electrodeposition bath, the method comprising:

feeding filtrate obtained by filtering by the first filtration membrane to a second filtration membrane which is a reverse osmosis filter;

feeding filtrate obtained by filtering with the second filtration membrane to the water washing bath of the last stage, and feeding a concentrated solution to a water washing bath other than the water washing bath of the last stage or the electrodeposition bath; and adjusting a feed amount of each of the filtrate obtained by filtration by the first filtration membrane and the filtrate obtained by filtration by the second filtration membrane to the water washing bath of the last stage.

9. An electrodeposition paint recovery method, wherein an electrodeposition bath in which electrodeposition painting is performed on an object to be painted, at least two water washing baths in which the object to be painted after electrodeposition painting is washed stepwise with water, and a first filtration membrane which is an ultrafiltration membrane or a microfiltration membrane, and which feeds filtrate obtained by performing filtration on electrodeposition solution containing electrodeposition paint in the electrodeposition bath to a washing bath at a last stage from among the at least two water washing baths and feeds a concentrated solution to the electrodeposition bath, are used, and water after water washing is fed from the water washing bath of the last stage sequentially in order from the water washing bath or baths located more toward the electrodeposition bath than the water washing bath of the last stage to the electrodeposition bath, the method comprising:

filtering, by a second filtration membrane which is a reverse osmosis membrane, filtrate water obtained by performing ultrafiltration or microfiltration on water after water washing in one of the at least two water washing baths with a third filtration membrane, and feeding a concentrated solution to a water washing bath more toward the electrodeposition bath than the one of the water washing baths or to the electrodeposition bath;

feeding a filtrate obtained by filtering with the second filtration membrane to the water washing bath of the last stage, and feeding a concentrated solution to a water washing bath other than the water washing bath of the last stage or the electrodeposition bath; and adjusting a feed amount of each of the filtrate obtained by filtration by the first filtration membrane and the filtrate obtained by filtration by the second filtration membrane to the water washing bath of the last stage.

10. The electrodeposition paint recovery method, as defined in claim 9, wherein the feed amount of the filtrate obtained by filtration by the first filtration membrane to the water washing bath of the last stage and the feed amount of the filtrate obtained by filtration by the second filtration membrane to the water washing bath of the last stage are adjusted so that a Na ion concentration of water after water washing in a water washing bath closest to the electrodeposition bath from among the at least two water washing baths is 30 ppm or less.

11. The electrodeposition paint recovery method, as defined in claim 10, wherein the electrical conductivity of water after water washing in the water washing bath of the last stage is measured, and wherein the feed amount of the filtrate obtained by filtration by the first filtration membrane to the water washing bath of the last stage and the feed amount of the filtrate obtained by filtration by the second filtration membrane to the water washing bath of the last stage is automatically adjusted based on the measured electrical conductivity.

12. The electrodeposition paint recovery method, as defined in either one of claim 9 and claim 8, wherein ratio V1:V2 of feed amount V1 of the filtrate obtained by filtration by the first filtration membrane to the water washing bath of the last stage and feed amount V2 of the filtrate obtained by filtration by the second filtration membrane to the water washing bath of the last stage is adjusted so as to be 1:2 through 2:1.

13. The electrodeposition paint recovery method, as defined in claim 12, wherein the ratio V1:V2 is adjusted so as to be 1:1.

14. The electrodeposition paint recovery method, as defined in either one of claim 9 and claim 8, wherein the second filtration membrane has a positive zeta potential.

* * * * *